US009604830B2

(12) United States Patent
Tygard

(10) Patent No.: US 9,604,830 B2
(45) Date of Patent: Mar. 28, 2017

(54) CLAMPING APPARATUS

(71) Applicant: Edward Tygard, McMurray, PA (US)

(72) Inventor: Edward Tygard, McMurray, PA (US)

(73) Assignee: Tygard Machine & Manufacturing Company, Washington, PA (US)

( * ) Notice: Subject to any disclaimer, the term of this patent is extended or adjusted under 35 U.S.C. 154(b) by 63 days.

(21) Appl. No.: 14/666,112

(22) Filed: Mar. 23, 2015

(65) Prior Publication Data

US 2015/0266709 A1 Sep. 24, 2015

Related U.S. Application Data

(60) Provisional application No. 61/968,577, filed on Mar. 21, 2014.

(51) Int. Cl.

| | |
|---|---|
| ***B66F 9/18*** | (2006.01) |
| ***B66C 1/62*** | (2006.01) |
| ***B66F 9/14*** | (2006.01) |

(52) U.S. Cl.

CPC ..... *B66F 9/183* (2013.01); *B66C 1/62* (2013.01); *B66F 9/148* (2013.01); *Y10S 414/124* (2013.01)

(58) Field of Classification Search

CPC . B66C 1/62; B66C 1/625; B66F 9/148; B66F 9/183; B66F 9/184; B66F 9/187; Y10S 414/124

USPC ..... 187/237; 414/623, 667, 785, 911

See application file for complete search history.

(56) References Cited

U.S. PATENT DOCUMENTS

| | | | | | |
|---|---|---|---|---|---|
| 1,840,487 | A * | 1/1932 | Clayburgh | B66C 1/62 | 294/87.24 |
| 2,645,372 | A | 7/1953 | Broersma | 214/652 | |
| 2,742,316 | A * | 4/1956 | Phillips | B66F 9/183 | 294/119.1 |
| 2,756,888 | A * | 7/1956 | Avery | B66F 9/187 | 414/621 |
| 2,827,189 | A | 3/1958 | Knudstrup | 214/620 | |
| 2,848,128 | A | 8/1958 | Thompson | 214/653 | |
| 2,924,484 | A * | 2/1960 | Tolsma | B66C 1/54 | 294/104 |
| 2,978,350 | A * | 4/1961 | Wilson | B28B 11/044 | 236/92 A |
| 3,002,639 | A * | 10/1961 | Cavanagh | B66F 9/188 | 414/623 |

(Continued)

FOREIGN PATENT DOCUMENTS

| | | | | |
|---|---|---|---|---|
| FR | 2995880 A1 * | 3/2014 | B66F 9/187 | |
| JP | 52-20556 A * | 2/1977 | B66F 9/18 | |

*Primary Examiner* — James Keenan

(74) *Attorney, Agent, or Firm* — Michael Tobias

(57) ABSTRACT

A clamping apparatus includes a frame adapted for mounting on a forklift so as to be raised and lowered along a mast of the forklift, a carriage supported by the frame for movement with respect to the frame in the widthwise direction of the forklift, two lifting arms supported by the carriage and extending in the widthwise direction of the frame, and a drive mechanism operatively connected to one of the lifting arms for producing relative movement of the lifting arms in the fore-and-aft direction of the frame to enable the lifting arms to grasp and release a load. The clamping apparatus can lift a portion of the objects in a closely-spaced layer and remove them from the layer without disturbing other objects in the layer. The clamping apparatus is particularly suitable for handling buckets.

18 Claims, 21 Drawing Sheets

(56) References Cited

U.S. PATENT DOCUMENTS

| | | | | | |
|---|---|---|---|---|---|
| 3,206,052 | A | | 9/1965 | Kennedy | 214/313 |
| 3,438,523 | A | | 4/1969 | Vik | 214/313 |
| 3,760,966 | A | | 9/1973 | Jones, Jr. et al. | 214/750 |
| 4,090,628 | A | | 5/1978 | Sinclair | 214/655 |
| 4,272,220 | A | | 6/1981 | Garcia | 414/607 |
| 4,279,564 | A | * | 7/1981 | Weinert | B66F 9/183 414/621 |
| 4,318,661 | A | | 3/1982 | Helm | 414/607 |
| 4,355,947 | A | | 10/1982 | Wiblin | 414/785 |
| 4,636,131 | A | * | 1/1987 | Sinclair | B66F 9/147 414/607 |
| 5,215,427 | A | | 6/1993 | Olsthoorn et al. | 414/664 |
| 5,366,339 | A | | 11/1994 | Gould | 414/607 |
| 5,688,102 | A | * | 11/1997 | Vieselmeyer | A01G 23/043 414/666 |
| 6,394,739 | B1 | | 5/2002 | Hutchinson | 414/729 |
| 6,969,225 | B2 | * | 11/2005 | Mensch | B66F 9/144 187/237 |
| 7,360,628 | B2 | | 4/2008 | Charvet | 187/237 |
| 7,599,777 | B2 | | 10/2009 | Passeri et al. | 701/50 |
| 7,841,822 | B2 | | 11/2010 | Tygard | 414/623 |
| 7,993,094 | B2 | | 8/2011 | Tygard | 414/785 |
| 8,016,334 | B2 | * | 9/2011 | Garrett | A01D 87/122 294/119.1 |
| 8,142,131 | B2 | | 3/2012 | Tygard | 414/623 |
| 2005/0135913 | A1 | * | 6/2005 | Visser | A01G 9/088 414/623 |
| 2010/0140021 | A1 | * | 6/2010 | Gillotti | B66F 9/12 187/237 |

* cited by examiner

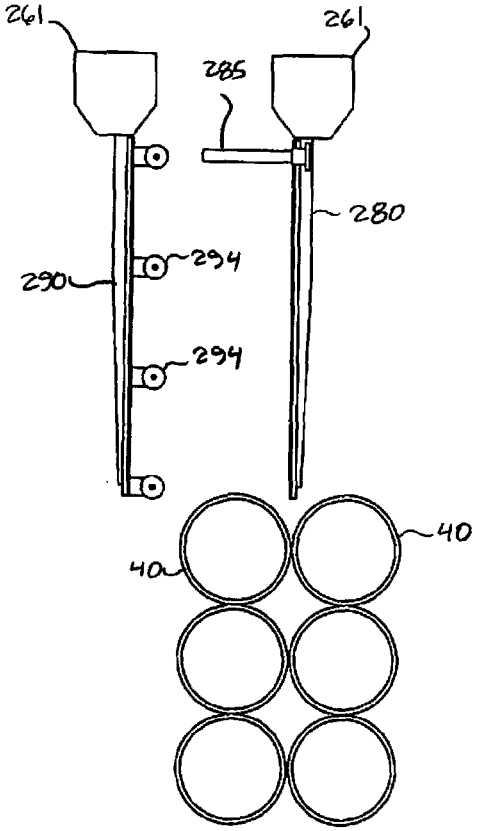
FIG. 19A
FIG. 19B
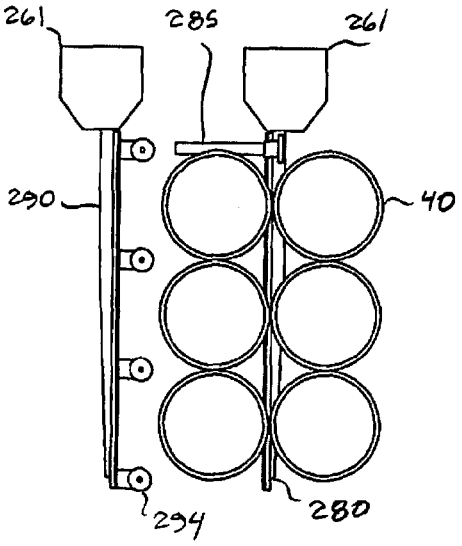
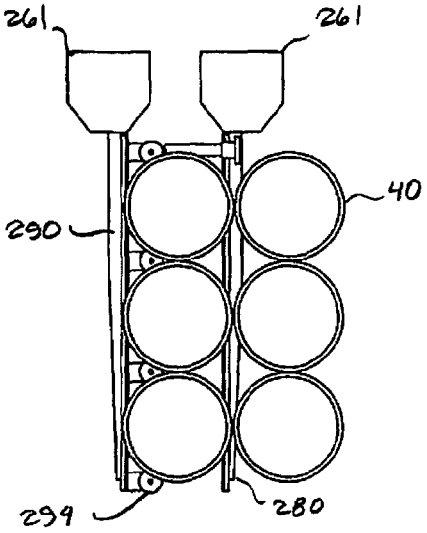
FIG. 19C
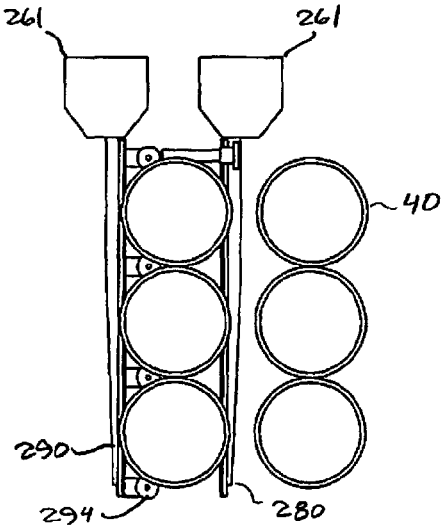
FIG. 19D

FIG. 20A
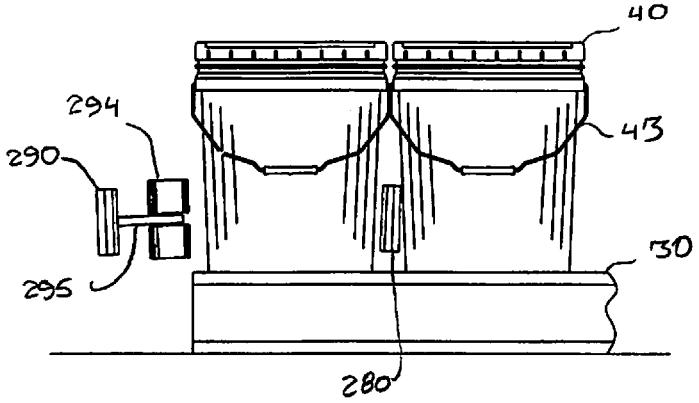
FIG. 20B
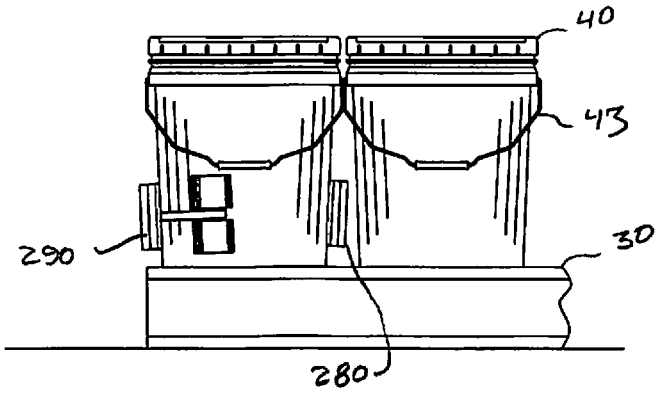
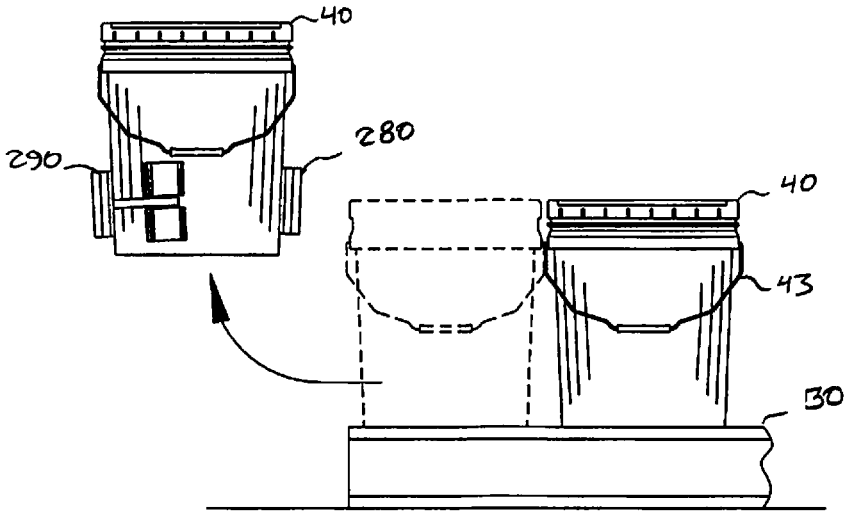
FIG. 20C

CLAMPING APPARATUS

REFERENCE TO RELATED APPLICATIONS

This application claims the benefit of U.S. Provisional Application No. 61/968,577 filed on Mar. 21, 2014, the disclosure of which is incorporated by reference.

TECHNICAL FIELD

This invention relates to a clamping apparatus and particularly a clamping apparatus capable of grasping and lifting buckets or other objects arranged in a closely-spaced layer.

BACKGROUND ART

A wide variety of materials used in construction industries are packaged in buckets. A few examples of such materials are paint, deck stain, waterproofing compound, drywall joint compound, spackle, putty, thin set mortar, flooring adhesive, roof coating, and driveway sealant. The buckets typically have a cylindrical or frustoconical body and a detachable lid which fits on the upper end of the body and can seal the interior of the bucket in an airtight and watertight manner. The body is frequently equipped with a handle. The size of such buckets typically ranges from less than 1 gallon up to 7 gallons, with 5-gallon buckets being particularly common. The term "5-gallon bucket" is a nominal designation, and it is often used to refer to a bucket containing less than exactly 5 gallons, such as 4.5-5 gallons. The lid usually has a somewhat larger diameter than the lower end of the body to allow one bucket to be stacked atop another bucket with the bottom end of the upper bucket nested in the lid of the lower bucket. Namely, the lower end of the upper bucket rests atop the lid of the lower bucket without extending outside of the outer periphery of the lid of the lower bucket. When products packaged in these buckets are shipped from one location to another, such as from a factory to a warehouse or from a warehouse to a store, it is common to place the buckets in one or more layers atop a pallet, with each bucket touching or closely spaced from adjoining buckets in the same layer. The buckets are usually loaded onto or unloaded from a pallet one at a time by hand. Not only is the process of loading and unloading buckets with respect to a pallet time-consuming, it is very arduous work on account of the weight of the buckets (a five-gallon bucket of latex paint will typically weigh on the order of 50 pounds) and can result in back strains and other injuries to workers.

Devices referred to as layer pickers have been developed for lifting entire layers of items from a pallet. However, layer pickers generally require that the sides of the objects in the layers be vertical, so they are not suitable for lifting a layer of frustoconical objects such as many buckets. In addition, layer pickers are not capable of selectively lifting just a portion of the objects in a layer rather than the entire layer.

Devices for lifting 55-gallon barrels have also been developed. However, such devices are unable to access closely-spaced objects and are therefore unsuitable for handling buckets disposed on a pallet in a closely-spaced layer.

Accordingly, there is a need for an apparatus which can lift a portion of the buckets arranged in a closely-spaced layer.

SUMMARY OF THE INVENTION

The present invention provides a clamping apparatus which is capable of lifting a plurality of buckets or other objects and loading or unloading them with respect to a pallet.

The present invention also provides a forklift arrangement including the clamping apparatus mounted on a forklift.

The present invention also provides a method of loading or unloading buckets or other objects with respect to a pallet using a clamping apparatus.

In this specification, a bucket refers to a container having a body with a bottom and a side wall which is defined by a surface of revolution about a vertical axis. Examples of the shape of the side wall of the body are cylinders and frustums of a cone. The bucket will usually include a lid closing the upper end of the body. The bucket may also include a handle for use in carrying the bucket. There is no limit on the size of the bucket, but typically it will have a capacity of from 1 to 7 gallons. A clamping apparatus according to the present invention is particularly useful in handling 5-gallon buckets, which here refers to buckets having a nominal capacity of 5 gallons.

A bucket which can be lifted by the clamping apparatus is not limited to one made of any particular material. In the building trades, such buckets are frequently made of plastic, but they can also be made of other materials such as metal, heavy cardboard, fiberglass, or pottery. There are no limitations on the type of material contained in a bucket being lifted by the clamping apparatus. For example, the bucket may contain any of the above-mentioned materials employed in construction industries which are commonly contained in buckets. It may also be used for a wide variety of other materials, such as foods, chemicals, or medicines.

A clamping apparatus according to the present invention will usually be employed to lift buckets containing a product such as the building materials mentioned above. However, a clamping apparatus according to the present invention can also be used to handle empty buckets, such as buckets which at one time held a product but which are now empty and are being transported to a recycling or hazardous waste facility. In the following description, the term bucket will be used to refer to both a container itself and to a container and the material enclosed within the container.

A clamping apparatus according to the present invention can be used to lift a single bucket or a plurality of buckets at the same time. When simultaneously lifting a plurality of buckets, the buckets may be arranged in a single level, or they may be arranged in multiple levels stacked atop one another.

A closely-spaced layer of objects refers to a layer of objects in which the minimum separation between adjoining objects (the separation between the adjoining objects at their closest points) is less than the largest dimension of the objects as viewed in plan. For example, in the case of buckets, a closely-spaced layer is a layer in which the minimum separation between adjoining buckets is less than the maximum diameter of an individual bucket. In the case of buckets used for building materials, the minimum separation between adjoining buckets in a closely-spaced layer is typically considerably less than the diameter, such as at most 6 inches, 1-2 inches, less than 1 inch, or at most 0.5 inches. In many cases, the adjoining buckets are contacting each other.

While a clamping apparatus according to the present invention is particularly suitable for use in lifting buckets, it may be used to lift other objects and particularly closely-spaced frustoconical objects, such as large flower pots in a nursery.

In addition, while the clamping apparatus is particularly suitable for lifting containers which have a body with a surface which is a surface of revolution, the clamping apparatus can also be used to lift containers having a different shape. It can also be used to lift objects other than containers.

A clamping apparatus according to the present invention can be supported by any device which is capable of maneuvering the clamping apparatus with respect to a load and particularly raising and lowering the clamping apparatus and any objects grasped by the clamping apparatus. The clamping apparatus will frequently be mounted on a forklift. Here, a forklift refers to a wide variety of wheeled vehicles having a mast on which forks can be mounted and which is capable of raising and lowering the forks.

A clamping apparatus according to the present invention can be used to perform a wide variety of methods. A few brief examples of such methods are listed below. In these examples, an object being handled by the clamping apparatus is a bucket, but similar methods can be carried out with respect to other types of objects.

Changing the spacing between buckets: The clamping apparatus can grasp a plurality of buckets arranged in a row on a support surface (such as a pallet or a floor) with an uneven spacing between adjoining buckets. In the process of grasping the buckets, the clamping apparatus produces a uniform spacing between adjoining buckets. The uniform spacing can be greater than or less than the initial spacing between adjoining buckets.

Aligning a plurality of buckets: The clamping apparatus can grasp a plurality of buckets arranged in an uneven row on a support surface. In the process of grasping the buckets, the clamping apparatus aligns the buckets along a straight line.

Grasping a single bucket: The clamping apparatus can grasp a single bucket having a minimum separation from an adjoining bucket of at most 1 inch without contacting the adjoining bucket. The two buckets may be resting directly on a support surface, or the buckets may be resting atop other buckets in a nested or non-nested relationship.

Grasping a row of buckets: The clamping apparatus can grasp a plurality of buckets arranged in a row having a minimum separation from an adjoining row of buckets of at most 1 inch without contacting the adjoining row of buckets. The two rows may be resting directly on a support surface, or the rows may be resting atop other rows of buckets in a nested or non-nested relationship.

Placing a row of buckets next to another row of buckets: The clamping apparatus can be used to place a first row of buckets, which is grasped by the clamping apparatus, next to a second row of buckets such that the minimum separation between the two rows of buckets is at most 1 inch without contacting the second row of buckets. The two rows may be resting directly on a support surface, or the rows may be resting atop other rows of buckets in a nested or non-nested relationship.

Forming a layer of buckets: The clamping apparatus can be used to place a plurality of rows of buckets, which are grasped one by one by the clamping apparatus, on a support surface to form a layer of buckets comprising the plurality of rows. The minimum separation between each row of buckets and the adjoining row is at most inch.

Forming a stack of buckets: The clamping apparatus can be used to grasp a first row of buckets and place it atop a second row of buckets to form a multi-layer stack of buckets. The first and second rows may be in a nested or non-nested relationship.

Forming a pyramid of buckets: The clamping apparatus can be used to stack a plurality of rows of buckets atop each other to form a pyramid comprising a plurality of layers. Each bucket in a layer can be in a nested or non-nested relationship with a layer immediately beneath it.

BRIEF DESCRIPTION OF THE DRAWINGS

FIGS. 19A-19D are schematic plan views of the lifting arms of the embodiment of FIG. 6 at various stages during the process of lifting a row of buckets from a pallet.

FIGS. 20A-20C are schematic elevations of the lifting arms of the embodiment of FIG. 6 at the stages shown in FIGS. 19B-19D, respectively, during the process of lifting a row of buckets from a pallet.

DESCRIPTION OF PREFERRED EMBODIMENTS

Figure 1:
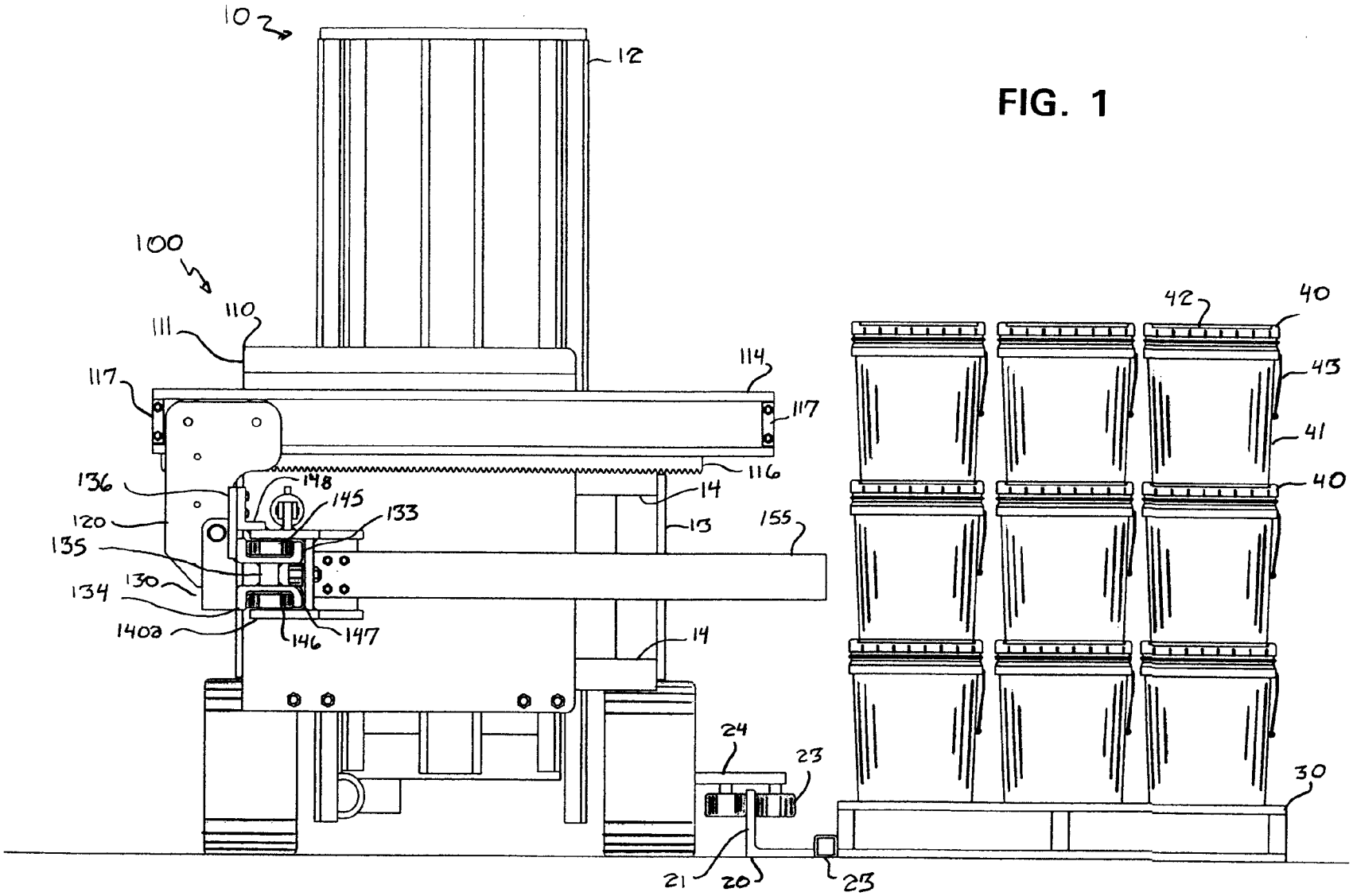
FIG. 1 is a front elevation of an embodiment of a clamping apparatus according to the present invention mounted on a forklift with the lifting arms of the clamping apparatus in a retracted position.

A first embodiment of a clamping apparatus 100 according to the present invention will be described while referring to FIGS. 1-5 of the accompanying drawings. The clamping apparatus 100 is shown mounted on the front of a forklift 10. The forklift 10 may be of conventional structure. It includes a self-propelled wheeled body 11 on which an operator can stand or sit while operating the forklift 10 and a mast 12 mounted on the front of the body 11. The forklift 10 may also be of the type which can be operated by an operator standing beside the body 11. The illustrated mast 12 is what is referred to as a two-stage mast, which includes a stationary pair of vertical outer channels and a movable pair of vertical inner channels which can be raised and lowered with respect to the outer channels. However, the mast 12 may also be a single-stage mast or one having three or more stages. A mast carriage 13 having mounting bars 14 for supporting forks or other forklift attachments is mounted on the front of the mast 12 in a conventional manner so as to be raised and lowered along the mast 12. The clamping apparatus 100 is mounted on the mast carriage 13 so that it can be raised and lowered together with the mast carriage 13. Structure for raising and lowering the inner channels of the mast 12 with respect to the outer channels and structure for raising and lowering the mast carriage 13 with respect to the mast 12 may be conventional and so has been omitted from the drawings.

The illustrated clamping apparatus 100 includes a rigid frame 110, a carriage 120 which can translate with respect to the frame 110 in a widthwise direction of the forklift 10, an arm support assembly 130 which is mounted on the carriage 120 for movement with the carriage 120, and first and second lifting arm assemblies 140*a* and 140*b* which are mounted on the arm support assembly 130. The lifting arm assemblies 140*a* and 140*b* include first and second rigid lifting arms 155 and 160, respectively, for lifting one or more buckets 40. At least one of the lifting arm assemblies 140*a* and 140*b* is capable of moving with respect to the arm support assembly 130 to adjust the separation between the lifting arms 155 and 160 and enable the lifting arms to grasp or release a load comprising one or more buckets 40.

The frame 110 is not restricted to any particular shape. In the present embodiment, it is generally L-shaped and includes a vertical portion 111 such as a steel plate which is detachably mounted on the mast carriage 13 of the forklift 10 and a horizontal portion 112 such as another steel plate which extends forward from the front side of the vertical portion 111. Conventional mounting brackets 113 for attaching the frame 110 to the mounting bars 14 of the mast carriage 13 of the forklift 10 are secured to the rear side of the vertical portion 111. Although not shown, openings through which hydraulic hoses can pass may be formed in various portions of the frame 110. Alternatively, the frame 110 can have an open structure formed by narrow bars, for example, instead of being defined by large solid plates.

Figure 3:
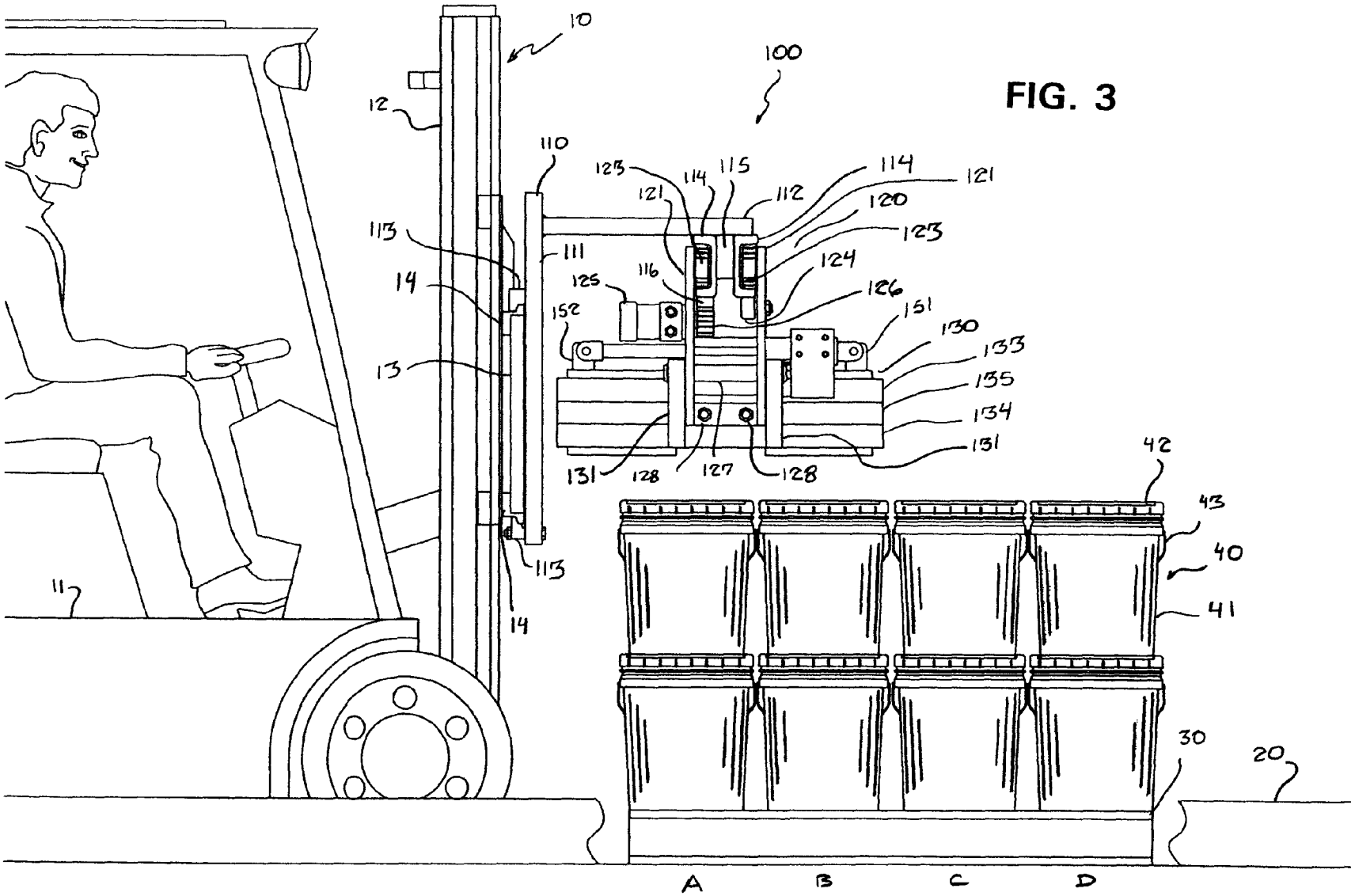
FIG. 3 is a side elevation of the embodiment of FIG. 1 as viewed from the left side in FIG. 1 with the lifting arms raised above a plurality of buckets stacked on a pallet.

The carriage 120 may be supported by the frame 110 in any convenient manner for translation in the widthwise direction of the forklift 10. In the present embodiment, the carriage 120 is supported by a pair of horizontal rails in the form of channels 114 which are secured to the underside of the horizontal portion 112 of the frame 110 near its front end. As shown in FIG. 3, the webs of the channels 114 are vertical, and the flanges of the channels 114 are horizontal and face away from each other. A spacer plate 115 is sandwiched between the webs of the channels 114 to give them rigidity. The length of the channels 114 can be selected based upon the distance it is desired for the lifting arms 155 and 160 to translate in their lengthwise direction. For example, if the clamping apparatus 100 is designed to be able to simultaneously lift three buckets disposed in a row, the length of the channels 114 is such as to allow the lifting arms 155 and 160 to translate by at least the length of the row of three buckets.

The illustrated carriage 120 includes two vertical side plates 121 which are rigidly connected to each other. Each of the side plates 121 is equipped with two rollers 123 which are rotatably connected to the side plates 121 for rotation about a horizontal axis. Each roller 123 is disposed inside one of the channels 114 and can roll along the inner surface of the lower flange of the corresponding channel 114. The forward of the two side plates 121 (the one located farther to the right in FIG. 3) is also equipped with a roller 124 which can rotate with respect to the side plate 121 about a horizontal axis and which rolls along the outer surface of the lower flange of the corresponding channel 114 so as to keep the carriage 120 level.

The carriage 120 can be made to translate along the channels 114 by any suitable mechanism, such as by a hydraulic or pneumatic piston, a cable/belt and pulley arrangement, a chain and sprocket arrangement, or a linear motor, to give a few examples. The present embodiment uses a rack and pinion arrangement for this purpose. An elongated rack 116 is secured to the bottom of the rear channel 114 with the teeth of the rack 116 facing downwards. A motor 125 having a rotating output shaft is secured to the rear side plate 121 of the carriage 120, and a pinion 126 is secured to and rotates with the output shaft of the motor 125 with the teeth of the pinion 126 engaging the teeth of the rack 116. When the motor 125 is operated to rotate the pinion 126, the engagement between the rack 116 and the pinion 126 causes the carriage 120 to translate in the lengthwise direction of the channels 114 to either the left or the right in FIG. 1. The present embodiment uses a hydraulic motor as the motor 125, but it is also possible to use a different type of motor such as an electric motor.

Stoppers or bumpers 117 can be provided at the lengthwise ends of one or both of the channels 114 to limit the movement of the carriage 120 in the lengthwise direction of the channels 114.

Figure 2:
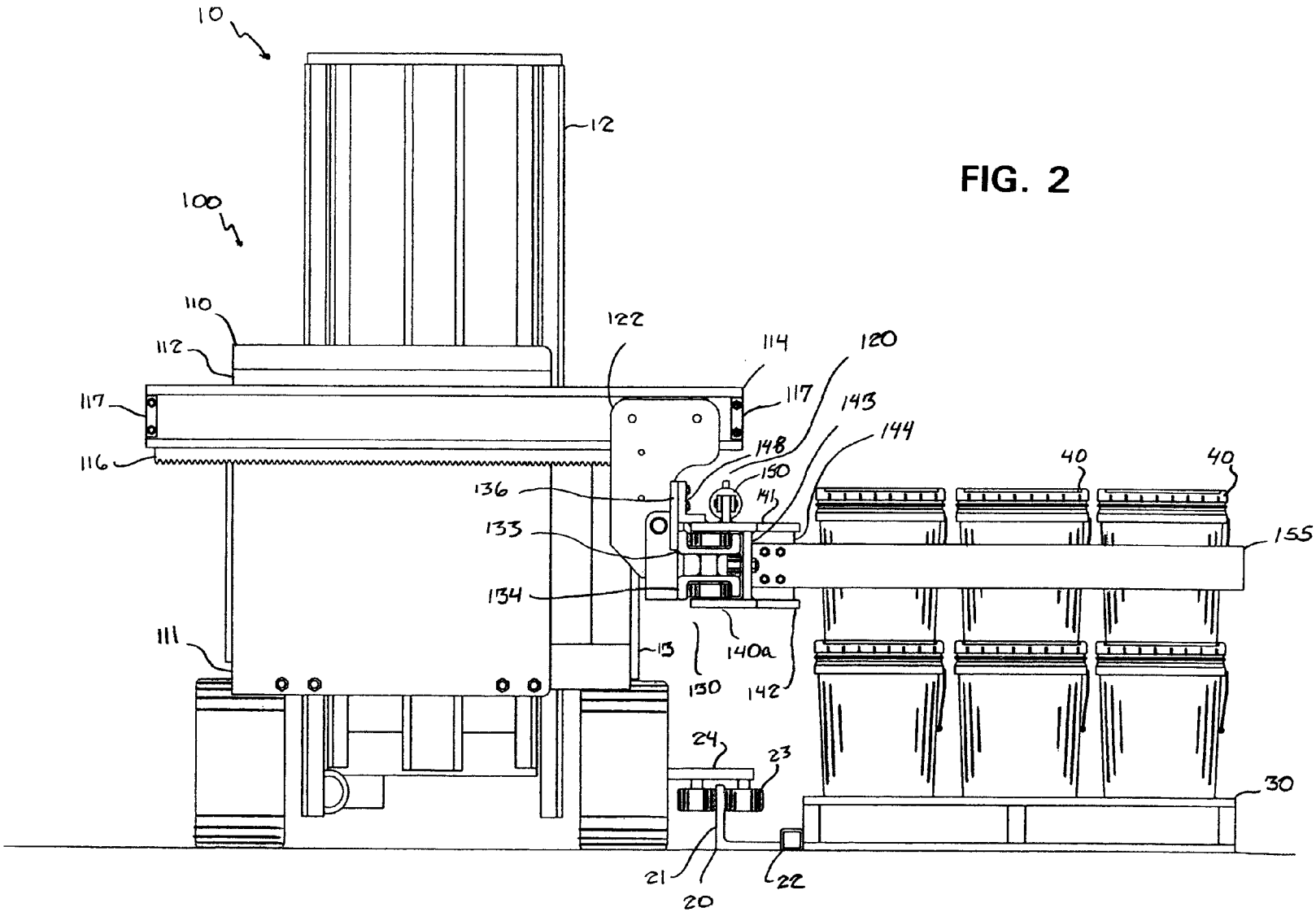
FIG. 2 is a front elevation of the embodiment of FIG. 1 with the lifting arms in an extended position in which they can grasp a row of buckets.

The arm support assembly 130 supports the lifting arm assemblies 140*a* and 104*b* so that at least one of the lifting arms 155 and 160 can move towards and away from the other lifting arm to enable the lifting arms 155 and 160 to grasp or release a load. In the present embodiment, the arm support assembly 130 includes two horizontal rails in the form of channels 133 and 134 which extend in the fore-and-aft direction of the forklift 10 for supporting the lifting arm assemblies 140*a* and 140*b*. As shown in FIGS. 1 and 2, the webs of the channels 133 and 134 are horizontal, and the flanges of the two channels are vertical and face away from each other. A spacer plate 135 is sandwiched between and secured to the two channels 133 and 134 to give them rigidity. The arm support assembly 130 includes two vertical side plates 131 which are connected to the side plates 121 of the carriage 120. In the present embodiment, the side plates 131 of the arm support assembly 130 are pivotably connected to the side plates 121 of the carriage 120 by a pin 127 so that the arm support assembly 130 can be pivoted with respect to the carriage 120 about a horizontal axis coinciding with the axis of the pin 127. Adjusting bolts 128 which are mounted on the carriage 120 and have ends which abut the arm support assembly 130 can be advanced or retracted to enable adjustment of the angle of the arm support assembly 130 with respect to the carriage 120 and of therefore the angle of the lifting arms 155 and 160 with respect to the horizontal so that the lifting arms can be made to extend parallel to the top surface of the pallet 30 or other surface on which the buckets 40 to be lifted are supported even when that surface or the surface on which the forklift 10 is traveling is not level.

Each lifting arm assembly 140*a* and 140*b* includes an upper plate 141, a lower plate 142, and two vertical plates 143 and 144 extending between and connected to the upper and lower plates 141 and 142. Two rollers 145 are rotatably mounted on the upper plate 141 for rotation about a generally vertical axis, two rollers 146 are rotatably mounted on the lower plate 142 for rotation about a generally vertical axis, and two more rollers 147 are rotatably mounted on one of the vertical plates 143 for rotation about a generally horizontal axis. Each lifting arm assembly 140*a* and 140*b* is mounted on the arm support assembly 130 so that the upper rollers 145 are disposed in the space between the flanges of the upper channel 133 of the arm support assembly 130, the lower rollers 146 are disposed in the space between the flanges of the lower channel 134 of the arm support assembly 130, and the horizontal rollers 147 rest atop and can roll along the web of the lower channel 134 of the arm support assembly 130.

In the present embodiment, the first lifting arm assembly 140*a* is secured to the arm support assembly 130 to prevent it from translating, and the second lifting arm assembly 140*b* can translate with respect to the arm support assembly 130 in the lengthwise direction of the channels 133 and 134. However, it is possible for both of the lifting arm assemblies 140*a* and 140*b* to be able to translate with respect to the arm support assembly 130. The first lifting arm assembly 140*a* in this embodiment has an L-shaped bracket 148 which is secured to the upper plate 141. The bracket 148 can be detachably secured by bolts to a plate 136 which is secured to the upper channel 133 of the arm support assembly 130. If it is desired to detach the first lifting arm assembly 140*a* from the arm support assembly 130, the bolts can be removed, and the first lifting arm assembly 140*a* can be rolled to the end of the channels 133 and 134 and removed.

The second lifting arm assembly 140*b* can be made to translate in the lengthwise direction of the channels 133 and 134 towards and away from the first lifting arm assembly 140*a* by a drive mechanism in the form of a hydraulic cylinder 150 which is connected between the two lifting arm assemblies 140*a* and 140*b*. One end of the hydraulic cylinder 150 is connected to a mounting lug 151 projecting upwards from the upper plate 141 of the first lifting arm assembly 140*a*, and the other end of the hydraulic cylinder 150 is connected to a mounting lug 152 projecting upwards from the upper plate 141 of the second lifting arm assembly 140*b*. When it is desired for both of the lifting arm assemblies 140*a* and 140*b* to be movable, a separate drive mechanism such as a separate hydraulic cylinder can be provided for each lifting arm assembly. Each hydraulic cylinder will have one end connected to one of the lifting arm assemblies and its other end connected to the arm support assembly 130. In this case, the L-shaped bracket 148 can be omitted.

The second lifting arm 160 can be moved with respect to the first lifting arm 155 between a position in which the minimum separation between the opposing surfaces of the lifting arms 155 and 160 is large enough for a bucket to be disposed between the two surfaces at their points of minimum separation without contacting either surface and a position in which the opposing surfaces of the lifting arms 155 and 160 are pressed against the sides of bucket(s) 40 with sufficient force for the lifting arms 155 and 160 to support the weight of the buckets 40 contacted by the lifting arms 155 and 160 and any other buckets stacked atop those buckets.

The lifting arms 155 and 160 can have any shape which enables them to together grasp one or more buckets 40. In addition, at least one of the lifting arms (the first lifting arm 155 in this embodiment) is preferably sufficiently slender that it can be inserted into the gap between any two adjoining rows of buckets 40 disposed on a pallet 30 by a distance corresponding to the number of buckets 40 which are to be grasped without contacting the sides of the rows of buckets. Although both lifting arms 155 and 160 may have the same shape and structure, in the present embodiment, the first lifting arm 155 has a substantially planar surface for grasping one or more buckets 40 to be lifted, while the second lifting arm 160 has a contoured surface which fits partway around the surface of buckets 40 to be lifted. The first lifting arm 155 in this embodiment comprises an elongated steel plate 156 which is secured at one end by bolts, for example, to vertical plate 144 of the first lifting arm assembly 140*a*. The second lifting arm 160 comprises a similar elongated steel plate 161 which is secured in a similar manner to vertical plate 144 of the second lifting arm assembly 140*b*. A plurality of projections 162 formed of steel plates are secured to the surface of the elongated plate 161 of the second lifting arm 160 opposing the first lifting arm 155. The size of the gaps between adjacent projections 162 is selected so that the sides of the projections 162 and the bottom of the spaces between adjacent projections 162 can contact the sides of buckets 40 being grasped. A nonskid material 157 and 162 such as a rubber sheet or a conveyor belt material can be attached to the surfaces of the lifting arms 155 and 160, respectively, opposing the buckets 40 to be grasped to increase the coefficient of friction between the buckets 40 and the lifting arms 155 and 160.

In this embodiment, the projections 162 have a generally trapezoidal outline, and the spaces between adjoining projections 162 likewise have a generally trapezoidal outline. However, the projections 162 may have a different shape. For example, the projections 162 and the spaces between adjoining projections may be curved, such as with a radius of curvature matching the radius of curvature of the sides of the buckets 40 as viewed in plan.

The body 41 of a bucket 40 is frequently tapered from top to bottom. The angle of taper, i.e., the angle of slope of the body 41 with respect to the vertical when the bucket 40 is on a level surface depends on the size of the bucket 40 but is frequently on the order of 2-3 degrees. In order to enhance the ability of the lifting arms 155 and 160 to grasp buckets 40 without pinching or permanently indenting them, the opposing surfaces of the lifting arms 155 and 160 for grasping buckets 40 may also be sloped with respect to the vertical by roughly the same angle of slope as the body 41 of a bucket 40, such as by 2-3 degrees. Such an angle of slope can be achieved by installing each lifting arm 155 and 160 at an angle to the vertical or by tapering the thickness of the lifting arms from their lower ends to their upper ends.

In the present embodiment, the clamping apparatus 100 is mounted on a forklift 10 so that the lengthwise direction of the lifting arms 155 and 160 extends in the widthwise direction of the forklift 10. It is also possible to mount the clamping apparatus 100 on a forklift 10 so that the lifting arms 155 and 160 extend in the fore-and-aft direction of the forklift 10. However, having the lifting arms 155 and 160 extend in the widthwise direction of a forklift 10 can be advantageous because it enables the forklift 10 to be used in confined spaces, such as along a narrow passage between rows of pallets or shelves.

In order to make it easier for the operator of the forklift 10 to accurately position the lifting arms 155 and 160 with respect to a load, the forklift 10 may be equipped with a guide system which guides the forklift 10 along a path without the operator having to steer the forklift 10. An example of a suitable guide system is described in U.S. Pat. No. 6,477,964 entitled "Guide System for a Forklift", the disclosure of which is incorporated by reference. The present embodiment includes a guide system comprising a guide rail 20 in the form of an angle iron secured to the floor of a warehouse or other facility where the forklift 10 is to be operated and two pairs of rollers 23 rotatably mounted on a bracket 24 secured to the side of the forklift 10. The two pairs of rollers 23 are provided in two locations spaced from each other in the fore-and-aft direction of the forklift 10. The guide rail 20 has a vertical leg 21 which extends vertically between the two rollers 23 of each pair of rollers so that the rollers 23 can roll along the sides of the vertical leg 21. The engagement between the rollers 23 and the guide rail 20 keeps the forklift 10 traveling in a direction parallel to the lengthwise direction of the guide rail 20. A positioning tube 22 with a rectangular cross section is secured to the horizontal leg of the guide rail 20. One or more pallets 30 containing loads to be accessed by the clamping apparatus 100 can be placed on the floor of the warehouse with an edge of each pallet 30 contacting or in close proximity to the positioning tube 22.

A forklift 10 on which the clamping apparatus 100 is mounted can of course be used without a guide rail, such as when the forklift needs to travel along random paths within a warehouse, a factory, a store, or other location.

Figure 5:
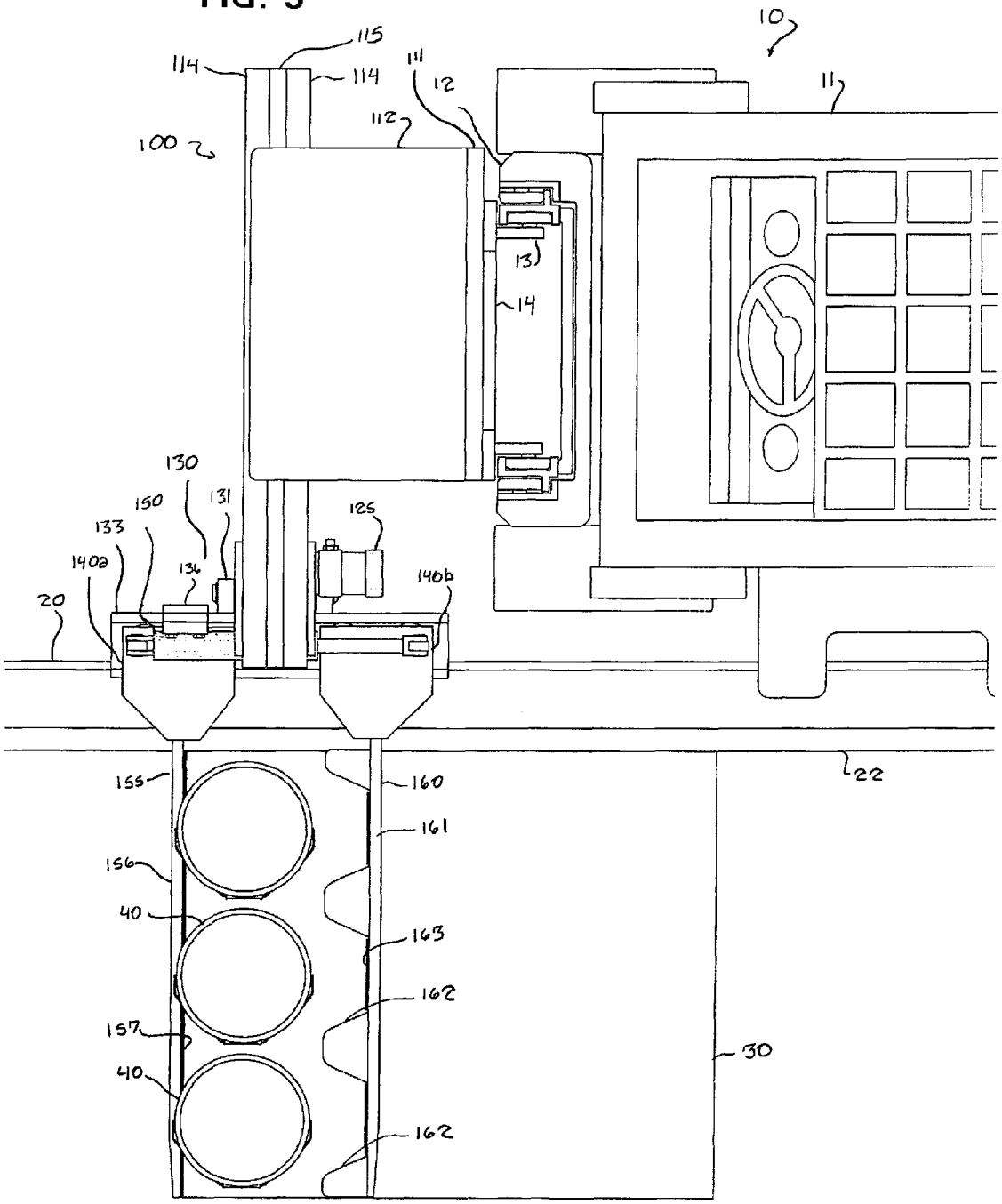
FIG. 5 is a plan view of the embodiment of FIG. 1 after a row of buckets has been moved to another pallet.
Figure 6:
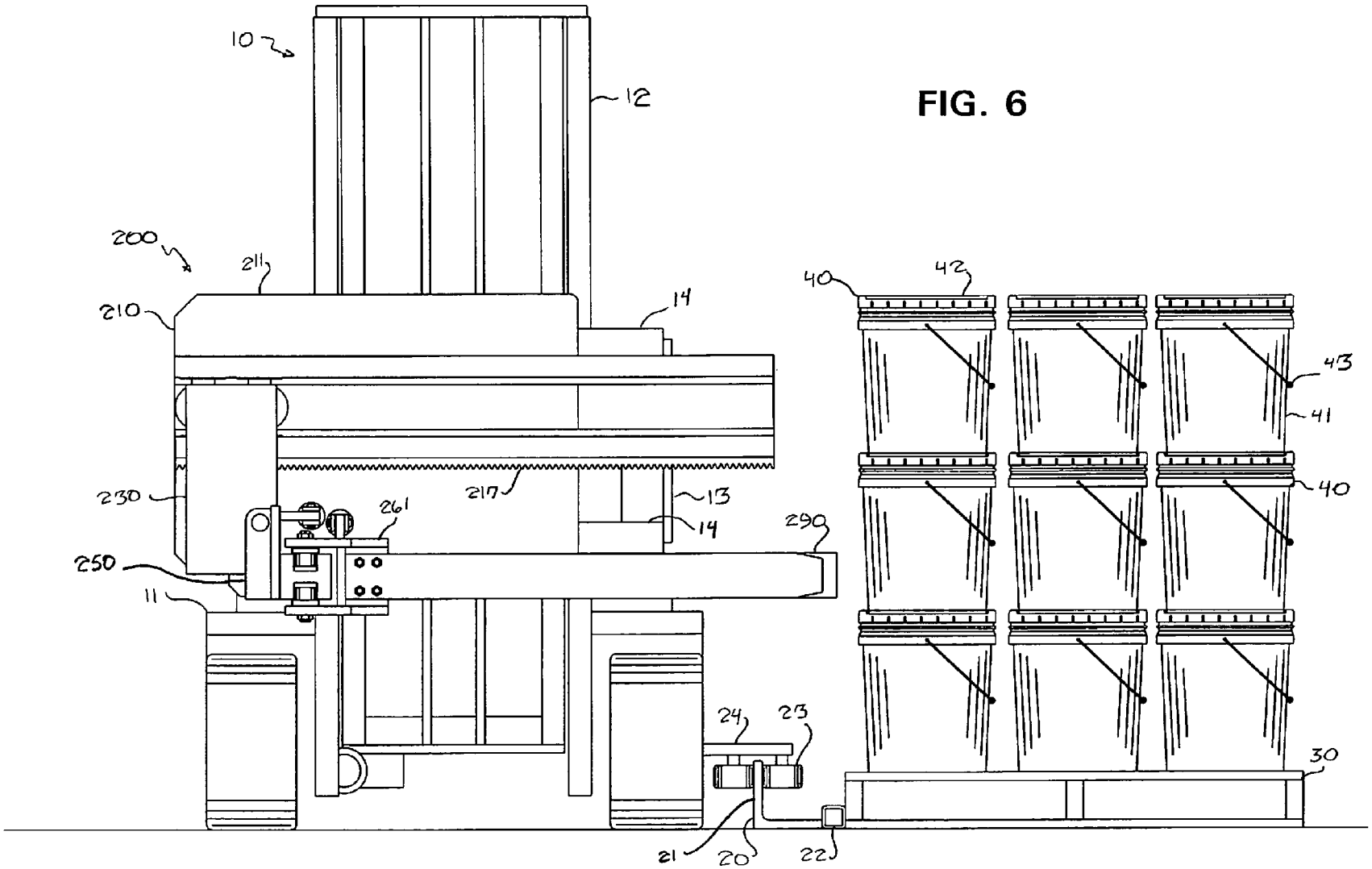
FIG. 6 is a front elevation of a second embodiment of a clamping apparatus according to the present invention mounted on a forklift with the lifting arms of the clamping apparatus in a retracted position.
Figure 7:
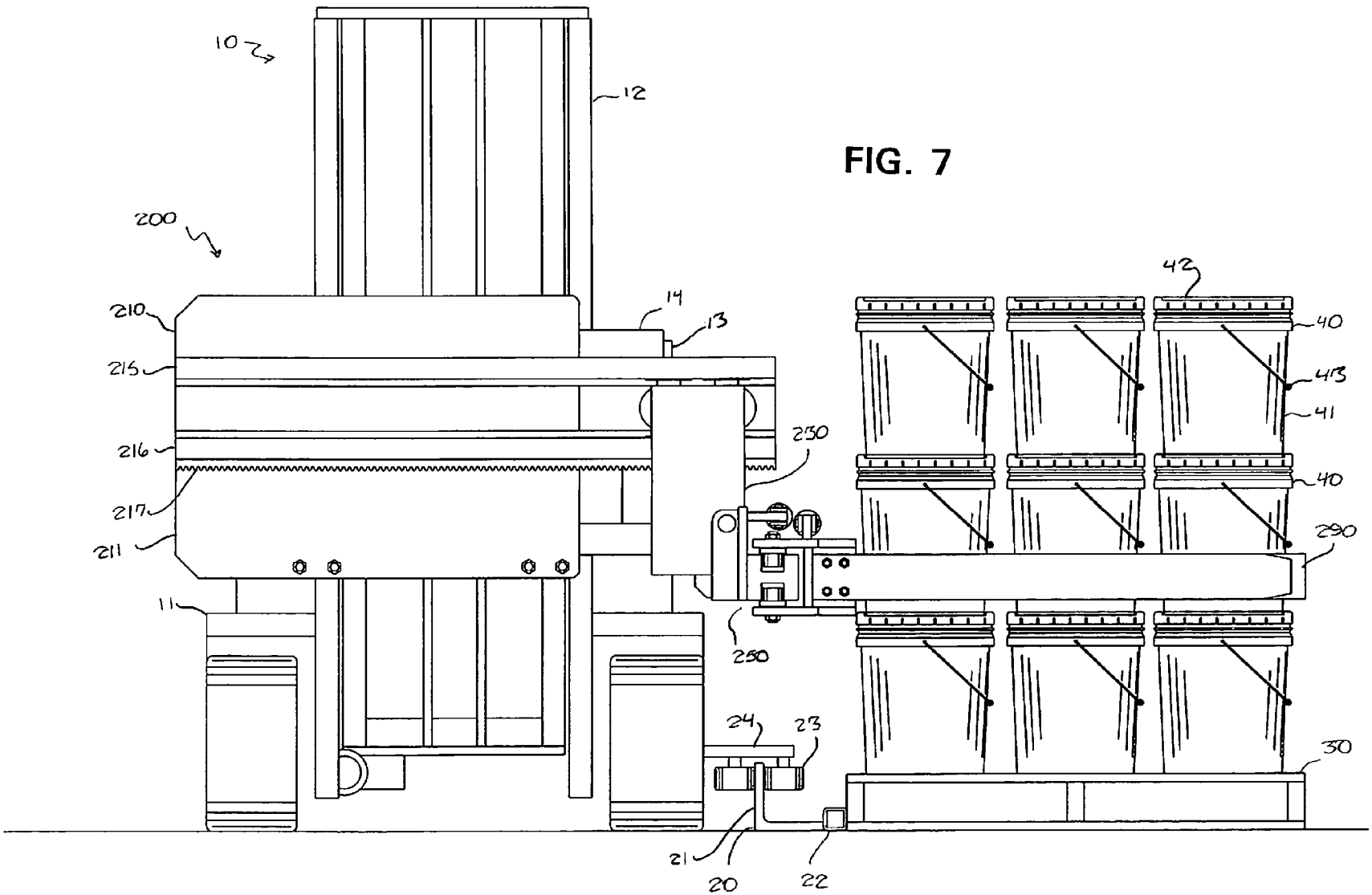
FIG. 7 is a front elevation of the embodiment of FIG. 6 with the lifting arms in an extended position in which they can grasp a row of buckets.

The length of the lifting arms 155 and 160 and the number of projections 162 on the second lifting arm 160 can be selected based on the number of buckets 40 which it is desired to grasp with the clamping apparatus 100 at one time. As shown in FIG. 5, the length of the lifting arms 155 and 160 and the number of projections 162 in this embodiment are such that the lifting arms 155 and 160 can grasp three closely-spaced buckets 40 at the same time.

Figure 4:
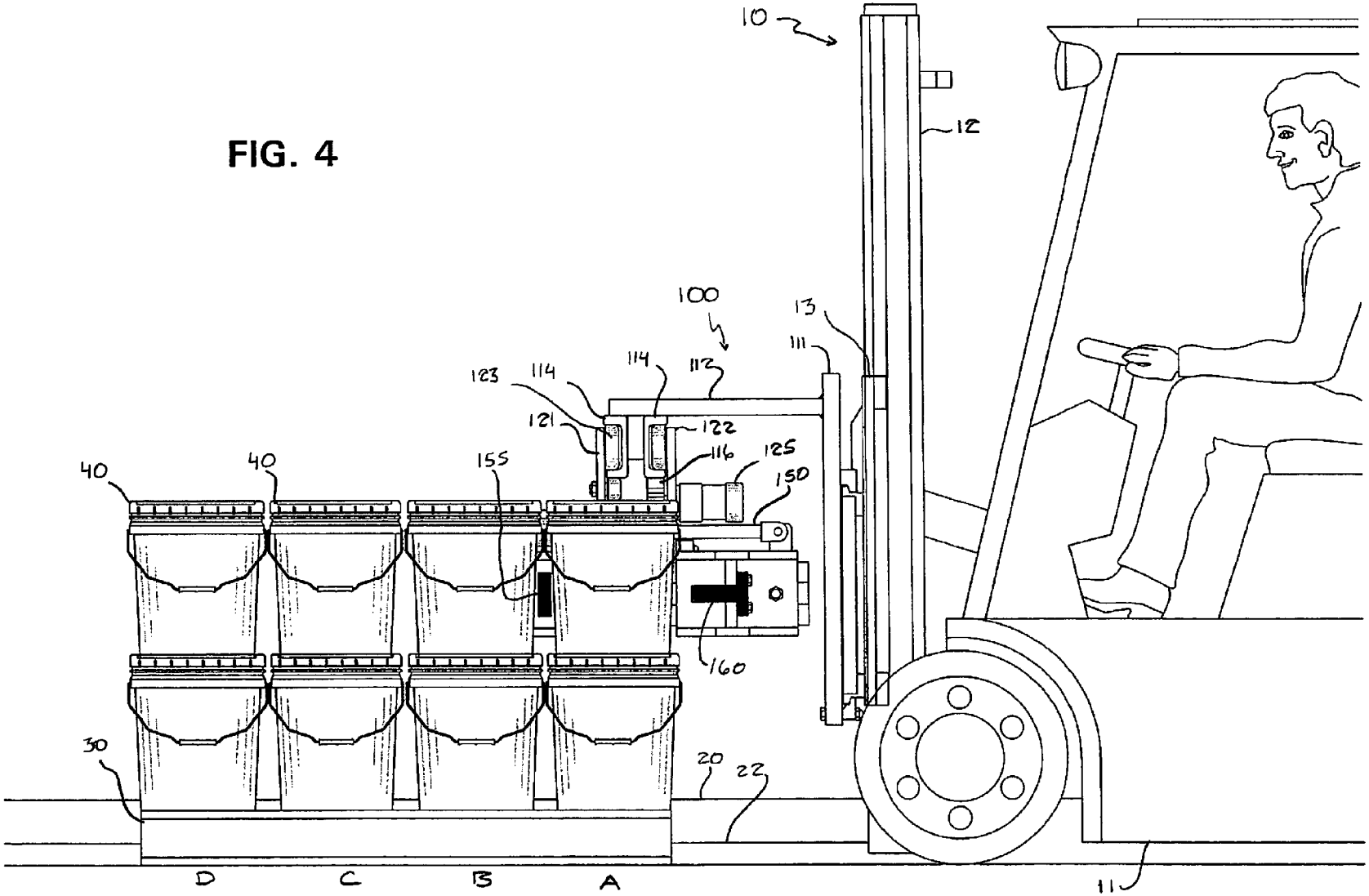
FIG. 4 is a side elevation of the embodiment of FIG. 1 as viewed from the right side in FIG. 1 showing the lifting arms in a position in which they can grasp a row of buckets.

An example of a method of using the illustrated embodiment of a clamping apparatus 100 will next be described. In this example, the buckets 40 to be lifted are 5-gallon buckets of paint, for example, stacked atop a pallet 30. In FIGS. 1-4, the buckets 40 are shown stacked in multiple layers. The number of buckets 40 in each layer will depend upon the size of the pallet 30 and the size of the buckets 40. Five-gallon buckets typically have a diameter of around 12 inches at their upper end and a diameter of around 10 inches at their lower end. On a pallet measuring 40×48 inches, which is a common size for a pallet, it is possible to form such 5-gallon buckets into one or more layers each containing 12 buckets arranged in a rectangular array comprising four rows with three buckets in each row. In FIGS. 3 and 4, the four rows of buckets 40 on a pallet are labeled as A, B, C, and D.

For ease of illustration, the buckets 40 are shown with a slight separation between adjoining buckets 40 at their upper ends, but they may be touching each other. The separation between adjoining buckets 40 is usually less than 6 inches, such as 1-2 inches or less than an inch, such as half an inch, at their upper ends. Each bucket 40 includes a removable lid 42 which seals the upper end of the body 41. The illustrated buckets 40 include handles 43. In FIGS. 1-4, the buckets 40 are in a nested relationship in which the lower end of the body 41 of each bucket 40 in the second layer of buckets rests atop and is nested in the lid 42 of a bucket in the first layer, and the lower end of the body 41 of each bucket 40 in the third layer of buckets (in FIG. 1) rests atop and is nested in the lid 42 of a bucket in the second layer.

With the lifting arms 155 and 160 in the retracted position shown in FIG. 1 in which they will not strike against any objects stacked on pallets 30 disposed along the guide rail 20, the forklift 10 can be driven along the guide rail 20 until the first lifting arm 155 is aligned with the gap between two adjoining rows of buckets 40. Specifically, as shown in FIG. 4, the first lifting arm 155 is aligned with the gap between the rightmost row A of buckets in the figure, which is an end row, and the next row B of buckets. At this time, the second lifting arm 160 is typically at its maximum separation from the first lifting arm 155, and a straight line perpendicular to the plane of the drawing which is an extension of the second lifting arm 160 is disposed to the right of end row A in FIG. 4.

The carriage 120 is then advanced to the right in FIG. 2 by the operation of the hydraulic motor 125 to advance both lifting arms 155 and 160 and insert the first lifting arm 155 into one of the layers of buckets 40 (the upper layer in FIGS. 2 and 4) into the gap between rows A and B by a distance corresponding to the number of buckets 40 which are to be grasped. The distance by which the first lifting arm 155 is inserted into the layer is preferably such that each of the buckets 40 to be grasped is approximately centered with respect to the gap between two consecutive projections 162 of the second lifting arm 160, which is positioned on the exterior of the layer. At this time, the opposing surfaces of both lifting arms 155 and 160 are preferably spaced from (i.e., not contacting) the surfaces of the buckets 40 to make it easier to position the lifting arms 155 and 160 with respect to the buckets 40 without disturbing the buckets 40.

Next, one or both of the lifting arms 155 and 160 is translated with respect to the arm support assembly 130 to bring the two lifting arms 155 and 160 into contact with the sides of the buckets 40 to be grasped. When only one of the lifting arms is able to translate with respect to the arm support assembly 130, e.g., when the first lifting arm 155 is stationary and the second lifting arm 160 is movable as in the present embodiment, the operator of the forklift 10 can drive the forklift 10 slightly backwards to bring the first lifting arm 155 into contact with one side of the buckets 40 to be grasped, and then the hydraulic cylinder 150 can be operated to move the second lifting arm 160 into contact with the other side of the buckets 40 to be lifted. When the clamping apparatus 100 is equipped with two drive mechanisms such as two hydraulic cylinders so that both lifting arms 155 and 160 can be translated towards and away from each other, the forklift 10 can remain in one place, and the two hydraulic cylinders can be operated to bring both lifting arms 155 and 160 into contact with the opposite sides of the buckets 40 to be lifted. The force with which the lifting arms 155 and 160 are pressed against the sides of the buckets 40 is set to be sufficient for the lifting arms 155 and 160 to support the weight of all the buckets 40 to be lifted without the buckets 40 sliding downwards with respect to the lifting arms. It is not necessary for any portion of the buckets 40 (such as the rims of the buckets 40 onto which the lids 42 are fit) to rest on the lifting arms 155 and 160. The clamping force required for the lifting arms to support the weight of the buckets 40 without slipping can be determined empirically. The height of the lifting arms 155 and 160 with respect to the buckets 40 at this time is preferably such that there is a clearance beneath the lifting arms 155 and 160 between the bottom surface of the lifting arms and the surface on which the buckets 40 being grasped are resting (such as another layer of buckets 40 or the pallet 30) and such that there is also a clearance above the lifting arms 155 and 160 between the top surface of the lifting arms and the handles 43 of the buckets 40 being grasped. The height of the lifting arms 155 and 160 can be adjusted by raising or lowering the mast carriage 13 of the forklift 10.

When both lifting arms 155 and 160 are movable with respect to the arm support assembly 130, the distances by which the lifting arms are capable of moving need not be the same for both lifting arms. When the first lifting arm 155 has a planar surface and the second lifting arm 160 has a contoured surface, the first lifting arm 155 can be translated by a smaller distance than the second lifting arm 160 in order to be moved between a position in which the first lifting arm 155 is pressed against the sides of buckets and a position in which it is sufficiently spaced from the sides of the buckets that it can be advanced or retracted with respect to a layer of buckets. When a separate hydraulic cylinder or other drive mechanism is provided for each lifting arm 155 and 160, the hydraulic cylinder for the first lifting arm 155 can be set so as to move the first lifting arm 155 by a first distance (such as by 1 or 2 inches), and the hydraulic cylinder for the second lifting arm 160 can be set so as to move the second lifting arm 160 by a second distance larger than the first distance (such as by 8 inches). The two hydraulic cylinders can be controlled so as to move the two lifting arms 155 and 160 at the same time or in sequence.

Once the lifting arms 155 and 160 are pressed against the buckets 40 with sufficient force, the mast carriage 13 of the forklift 10 is raised to lift the load off the surface on which it is resting (either the pallet 30 or a layer of buckets 40 beneath the buckets being lifted). If the first lifting arm 155 is sufficiently thin, the row of buckets 40 being lifted can be raised all the way to above the adjoining row of buckets 40 in a single vertical movement without disturbing the adjoining row. If the first lifting arm 155 is not sufficiently thin to allow the buckets 40 to be raised in a single vertical movement, the lifting arms 155 and 160 can first be raised by a small distance, such as one or two inches, to produce a clearance between the buckets 40 being lifted and the surface on which they were resting, and then the forklift 10 can be driven slightly backwards to move the row of buckets 40 being lifted horizontally away from the other buckets 40 remaining on the pallet 30. Once the buckets 40 being lifted by the lifting arms 155 and 160 are out of the way of the remaining buckets 40 on the pallet 30, the forklift 10 can then be driven along the guide rail 20 to a location where the buckets 40 lifted by the lifting arms 155 and 160 are to be deposited. During the transport of the buckets 40, the lifting arms 155 and 160 can be in the extended position shown in FIG. 2 or the retracted position shown in FIG. 1, and the height of the buckets 40 grasped by the lifting arms can be adjusted so as to clear any possible obstructions along the path to where the buckets 40 are to be deposited by adjusting the height of the mast carriage 13.

When the forklift 10 reaches the location where the buckets 40 are to be deposited, the clamping apparatus 100 is lowered by the forklift 10 until the buckets 40 rest atop a suitable surface, such as another pallet 30. The hydraulic cylinder 150 is operated to move the second lifting arm 160 away from one side of the buckets 40. FIG. 5 shows a state after a row of three buckets 40 have been placed atop a pallet 30 and the second lifting arm 160 has been moved away from the sides of the buckets 40. In this state, the first lifting arm 155 is still contacting the buckets 40. If the lifting arms 155 and 160 were retracted with the first lifting arm 155 in frictional contact with the buckets 40, the movement of the first lifting arm 155 might disturb the positions of the buckets 40 on the pallet 30. Therefore, the forklift 10 can be driven slightly forwards in FIG. 5 until the first lifting arm 155 is no longer contacting the other side of the buckets 40, and then the lifting arms 155 and 160 can be retracted by moving the carriage 120 away from the buckets 40 until the carriage 120 is in the position shown in FIG. 2. The forklift 10 can then be driven to another location to collect more buckets 40. When the lifting arm assemblies 140*a* and 140*b* are equipped with multiple hydraulic cylinders so that both lifting arms 155 and 160 are movable towards and away from each other, the lifting arms 155 and 160 can both be moved away from the sides of the buckets 40 by operation of the hydraulic cylinders without it being necessary to move the forklift 10 before retracting the lifting arms.

In the method described above, the clamping apparatus 100 is used to lift a plurality of buckets 40 at the same time. However, it is also possible for the clamping apparatus 100 to lift a single bucket 40, such as one bucket in a layer of buckets 40.

FIG. 5 shows a row of buckets 40 being placed atop a pallet 30. However, as long as there is sufficient room for the lifting arms 155 and 160 to move without striking adjoining objects, the buckets 40 can be placed by the clamping apparatus 100 in a variety of locations, such as on a shelf, on a table, or atop other buckets 40. In hardware stores, buckets are often stored on the floor in multiple rows underneath shelves. The clamping apparatus 100 can be used to arrange multiple rows of buckets 40 in a closely-spaced arrangement on a floor. By careful manipulation of the lifting arms 155 and 160, the clamping apparatus 100 can also be used to form a closely-spaced layer of buckets containing multiple adjoining rows by placing rows of buckets one at a time on a support surface. For example, the clamping apparatus 100 can place a second row of three buckets 40 on a pallet 30 just to the right of the row shown in FIG. 5, it can then place a third row of three buckets 40 just to the right of the second row, and so forth until a desired number of rows have been formed.

FIGS. 6-21 illustrate a second embodiment of a clamping apparatus 200 according to the present invention. The clamping apparatus 200 is shown mounted on the front of a forklift 10 like the one described above with respect to the first embodiment. The clamping apparatus 200 can be raised and lowered along the mast 12 of the forklift 10 in the same manner as in the first embodiment. However, like the first embodiment, this embodiment is not limited to use with a forklift.

Like the first embodiment, this embodiment of a clamping apparatus 200 includes a rigid support frame 210, a carriage 230 which can translate with respect to the support frame 210 in a widthwise direction of the forklift 10, an arm support assembly 250 which is mounted on the carriage 230 for movement with the carriage 230 in the widthwise direction of the forklift 10, and first and second lifting arm assemblies 260*a* and 260*b* which are mounted on the arm support assembly 250. The lifting arm assemblies 260*a* and 260*b* include first and second rigid lifting arms 280 and 290, respectively, for grasping and lifting one or more buckets 40. At least one of the lifting arm assemblies 260*a* and 260*b* is capable of moving with respect to the arm support assembly 250 to adjust the separation between the lifting arms 280 and 290 and enable the lifting arms to grasp or release a load comprising one or more buckets 40.

In this embodiment, the support frame 210 includes a rigid support plate 211 which is detachably mounted on the front side of the mast carriage 13 of the forklift 10 by conventional mounting brackets 212 which are secured to the rear side of the support plate 211 and attached to the mounting bars 14 of the mast carriage 13 of the forklift 10. Unillustrated openings through which hydraulic hoses can pass may be formed in the support plate 211.

Figure 8:
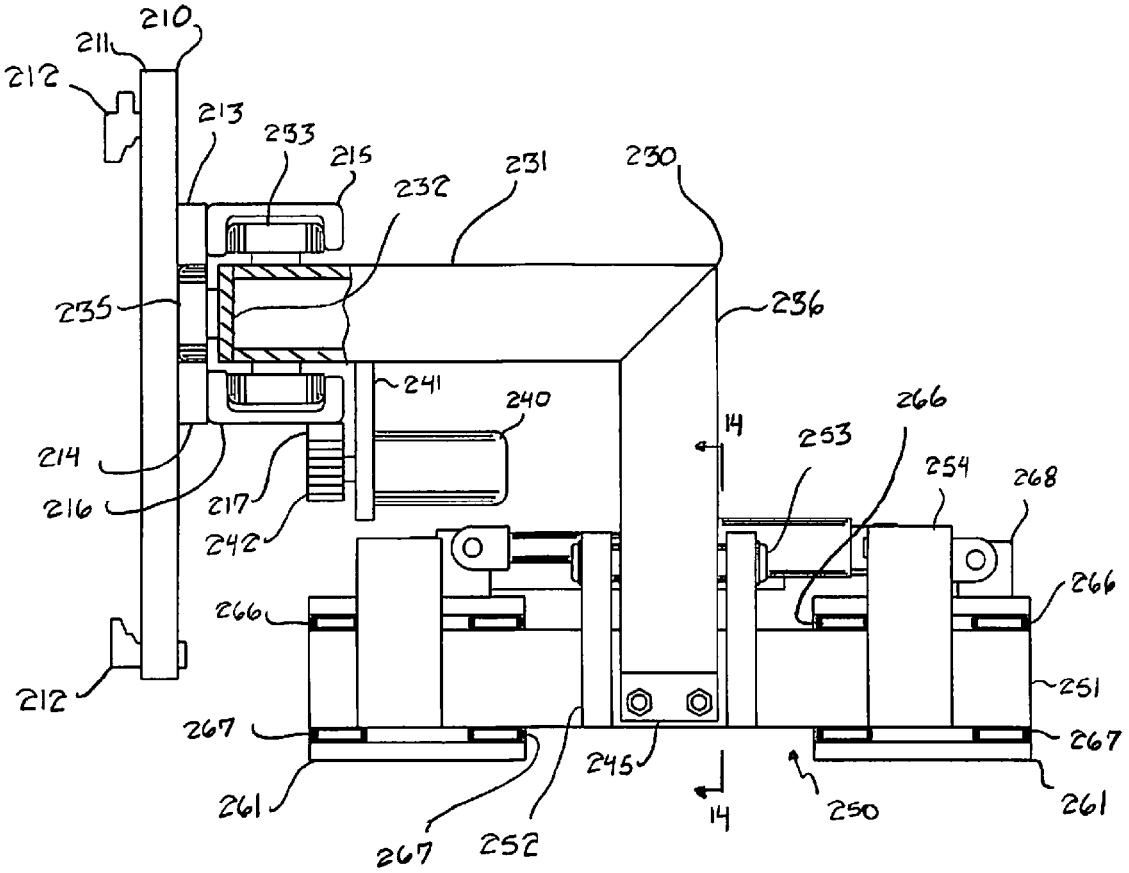
FIG. 8 is a cut-away elevation of the embodiment of FIG. 6 as viewed from the left side in FIG. 6.

Horizontal rails for supporting the carriage 230 for movement with respect to the forklift 10 are secured to the front side of the support plate 211. As best shown in FIG. 8, which is a cut-away elevation of the embodiment of FIG. 6 as viewed from the left side in FIG. 6, the rails include upper and lower elongated bars 213 and 214 which are secured to the front side of the support plate 211 and extend parallel to each other in the widthwise direction of the support plate 211 and upper and lower channels 215 and 216 which are secured to the front sides of the bars 213 and 214 opposing each other and extend parallel to each other and to the bars 213 and 214 in the widthwise direction of the support plate 211. Each channel 215 and 216 has a horizontal web and two vertical flanges which extend towards the opposing channel when the channels are viewed in their lengthwise direction. As in the first embodiment, the length of the rails defined by the bars 213 and 214 and the channels 215 and 216 is selected based upon the distance which it is desired for the lifting arms to translate in their lengthwise direction, which depends upon the number of buckets 40 which are to be lifted at one time. In the present embodiment, the carriage 230 can travel along the rails by at least the diameters of three 5-gallon buckets disposed next to each other, i.e., by at least approximately 36 inches to as to be able to lift at least three buckets 40 disposed in a row at one time.

The carriage 230 in this embodiment is a generally L-shaped rigid member comprising steel tubes each having a rectangular transverse cross section. The carriage 230 includes a horizontal leg 231 extending horizontally forwards with respect to the support frame 210 in the fore-and-aft direction of the forklift 10 and a vertical leg 236 which extends vertically downwards from the front end of the horizontal leg 231. The rear end of the horizontal leg 231 (the left end in FIG. 8) is supported by the rails of the support frame 210 for movement in the lengthwise direction of the rails, i.e., in the widthwise direction of the forklift 10. The rear end of the horizontal leg 231 is equipped with two upper rollers 233 which are each mounted on the top side of the horizontal leg 231 for rotation about a vertical axis, two lower rollers 234 which are each mounted on the bottom side of the horizontal leg 231 for rotation about a vertical axis, and two rear rollers 235 which are each mounted on a plate 232 secured to the rear end of the horizontal leg 231 for rotation about a horizontal axis. Each of the upper and lower rollers 233 and 234 is disposed inside one of the upper and lower channels 215 and 216 of the support frame 210 and can roll along the interior of the corresponding channel as the carriage 230 moves in the widthwise direction of the forklift 10. Each of the rear rollers 235 is disposed between the upper and lower bars 213 and 214 and can roll along the space between the two bars in the lengthwise direction thereof.

In the same manner as in the first embodiment, the carriage 230 of this embodiment can be made to translate along the rails by a drive mechanism comprising a rack and pinion, although any other suitable drive mechanism such as the mechanisms described with respect to the first embodiment can instead be used. An elongated rack 217 is secured to the bottom of the lower channel 216 with the teeth of the rack 217 facing downwards. A motor 240 having a rotating output shaft is secured to a support plate 241 which extends downwards from the horizontal leg 231 of the carriage 230, and a pinion 242 is secured to and rotates with the output shaft of the motor 240 with the teeth of the pinion 242 engaging the teeth of the rack 217. When the motor 240 is operated to rotate the pinion 242, the engagement between the rack 217 and the pinion 242 causes the carriage 230 to translate in the lengthwise direction of the rails of the support frame 210 (in the widthwise direction of the forklift 10) to either the left or the right in FIGS. 6 and 7. Like the first embodiment, this embodiment uses a hydraulic motor as the motor 240, but a different type of motor may instead be employed.

As in the first embodiment, stoppers or bumpers (not shown in the figures) can be provided at the lengthwise ends of the rails to limit the movement of the carriage 230 in the lengthwise direction of the rails.

Figure 12:
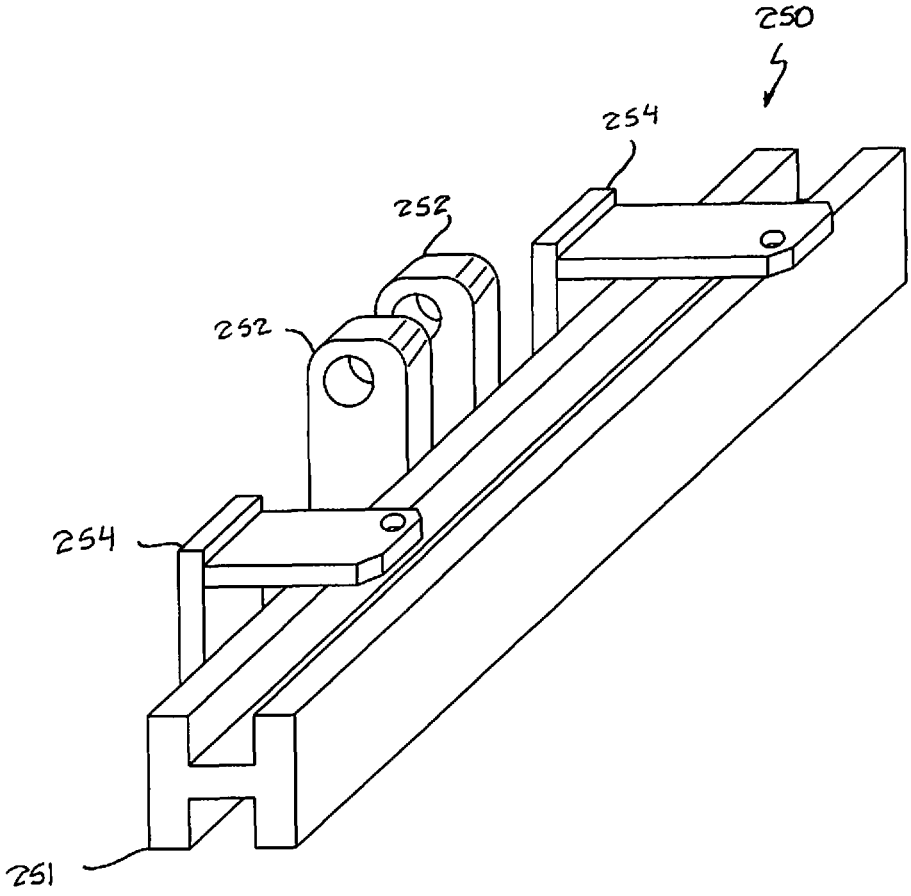
FIG. 12 is an axonometric view of the beam of the arm support assembly.

The arm support assembly 250 supports the lifting arm assemblies 260*a* and 260*b* so that at least one of the lifting arms 280 and 290 can move towards and away from the other lifting arm to enable the lifting arms to grasp or release a load. In the present embodiment, the arm support assembly 250 includes an H-shaped beam 251 which defines horizontal rails which extend in the fore-and-aft direction of the forklift 10 and movably support the lifting arm assemblies 260*a* and 260*b*. As best shown in FIG. 12, the beam 251 includes a horizontal web and two vertical flanges secured to the ends of the web. Two support plates 252 and two L-shaped mounting brackets 254 are secured to the rear side of the beam 251. A pin 253 extends between the two support plates 252 and passes through corresponding holes 237 in the vertical leg 236 of the carriage 230 to enable the arm support assembly 250 to pivot with respect to the carriage 230 about the axis of the pin 253, which extends in the fore-and-aft direction of the forklift 10. When the mast 12 of the forklift 10 is vertical, the axis of the pin 253 is typically horizontal.

Figure 9:
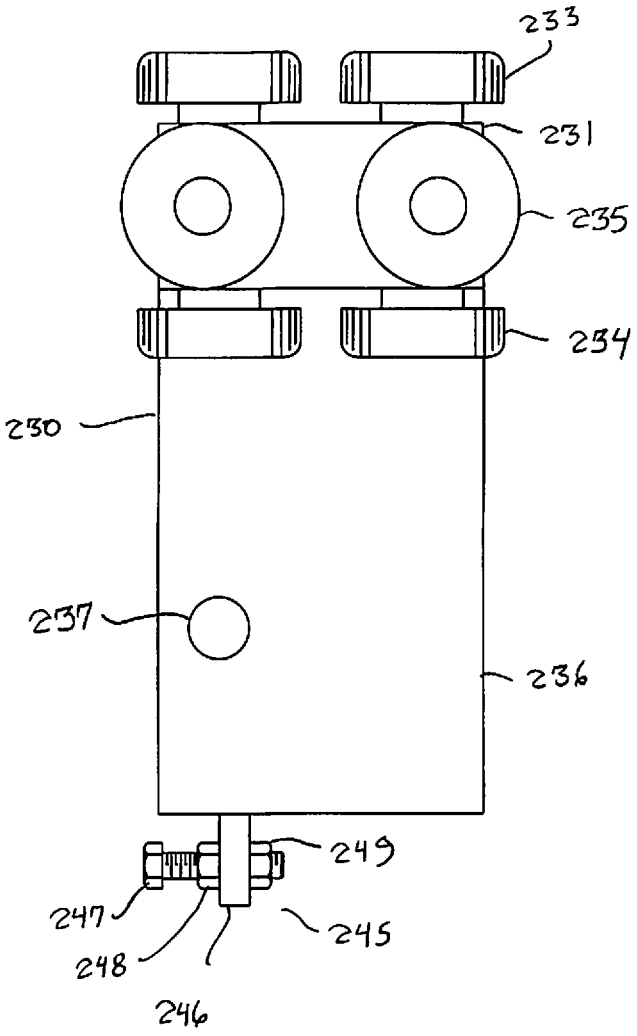
FIG. 9 is an elevation of the carriage of the embodiment of FIG. 6 as viewed from the left side in FIG. 8.
Figure 14:
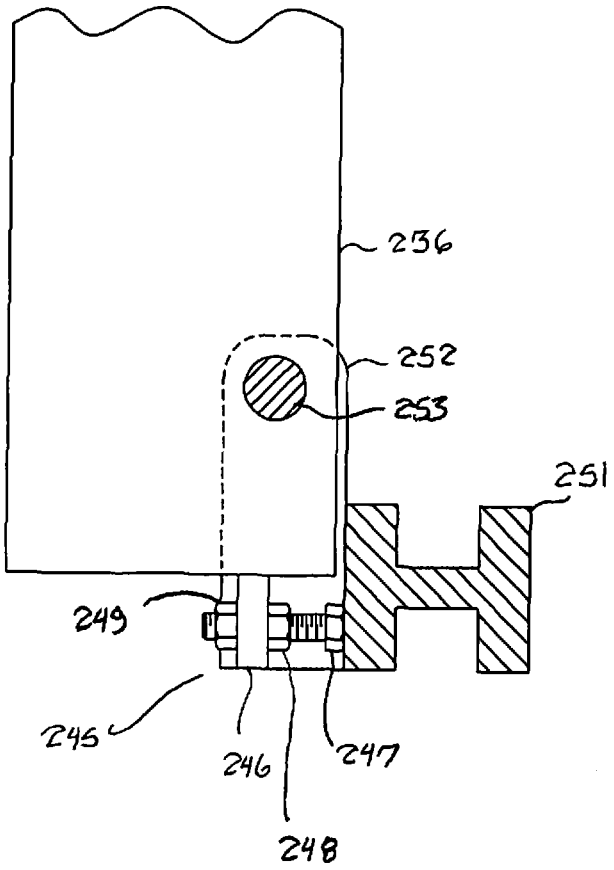
FIG. 14 is a vertical cross-sectional view taken along line 14-14 in FIG. 8 showing the angle adjusting mechanism for the lifting arm assembly.

In many situations, the floor of a warehouse or other facility in which the clamping apparatus 200 is used is not level, and the surface on which the forklift 10 travels and the surface on which a pallet containing a load is disposed may not be parallel to each other. For optimal operation of the clamping apparatus 200, the lengthwise direction of the lifting arms 280 and 290 is preferably parallel to the top surface of a pallet on which a load is disposed. Similar to the first embodiment, the present embodiment is equipped with an angle adjusting mechanism 245 to enable an operator to adjust the angle of the lifting arms 280 and 290 with respect to the surface of a pallet or other support surface for a load. As shown in FIGS. 8, 9, and 14, the angle adjusting mechanism 245 includes a support plate 246 which extends downwards from the lower end of the vertical leg 236 of the carriage 230, and two adjusting bolts 247 which are supported by the support plate 246 with the head of each adjusting bolt 247 abutting against the rear surface of the beam 251 of the arm support assembly 250. Each adjusting bolt 247 passes through the support plate 246 and is threadingly engaged with a first nut 248 which is secured to the support plate 246 by welding, for example. A second nut 249 which functions as a lock nut is threaded on the adjusting bolt 247 and is tightened against the support plate 246 so as to resist rotation of the adjusting bolt 247. When the second nut 249 is loosened, the adjusting bolt 247 can be rotated with respect to the first nut 248 to adjust the distance by which the head of the adjusting bolt 247 extends forwards from the support plate 246. At the completion of adjustment of the position of the adjusting bolt 247, the second nut 249 can be tightened to lock the adjusting bolt 247 in the desired position. The weight of the arm support assembly 250 and the structure which it supports causes the arm support assembly 250 to pivot about the center of the pivot pin 253 until the rear surface of the beam 251 contacts the head of the adjusting bolt 247 as shown in FIG. 14. Therefore, the distance by which the head of the adjusting bolt 247 extends forwards from the support plate 246 determines the angle of the beam 251 with respect to the horizontal and accordingly the angle of the lifting arms 280 and 290 with respect to the horizontal.

Each lifting arm assembly 260*a* and 260*b* includes a lifting arm holder 261 to which one of the lifting arms 280 and 290 is secured. Each lifting arm holder 261 includes an upper plate 262, a lower plate 263, and two vertical plates 264 and 265 extending between and connected to the upper and lower plates 262 and 263. Two track rollers 266 are rotatably mounted on the upper plate 262 for rotation about a generally vertical axis, and two more track rollers 267 are rotatably mounted on the lower plate 263 for rotation about a generally vertical axis. Each lifting arm assembly 260*a* and 260*b* is mounted on the arm support assembly 250 so that the upper track rollers 266 are disposed in the space between the flanges of the beam 251 of the arm support assembly 250 on the upper side of the beam 251 and so that the lower track rollers 267 are disposed in the space between the flanges of the beam 251 on the lower side of the beam 251. The track rollers 266 and 267 are able to resist both vertical and horizontal loads. As a result, the track rollers 266 and 267 can transmit the weight of the lifting arm assemblies 260*a* and 260*b* as well as any load grasped by the lifting arms 280 and 290 to the beam 251 and at the same time allow the lifting arm assemblies to translate along the beam 251.

The lifting arms 280 and 290 can grasp and release a load as long as one of the lifting arm assemblies 260*a* and 260*b* is capable of moving along the beam 251 towards and away from the other lifting arm assembly. In the present embodiment, both of the lifting arm assemblies 260*a* and 260*b* are capable of translating along the beam 251 of the arm support assembly 250. Two drive mechanisms in the form of first and second hydraulic cylinders 269 and 270, for example, are provided for moving the lifting arm assemblies 260*a* and 260*b* in the lengthwise direction of the beam 251. One end of each hydraulic cylinder 269 and 270 is connected to one of the L-shaped mounting brackets 253 which are secured to the beam 251, and the other end of each hydraulic cylinder is connected to a mounting lug 268 which extends upwards from the upper plate 262 of each of the lifting arm holders 261. It is possible to move the lifting arm assemblies 260*a* and 260*b* towards and away from each other using a single hydraulic cylinder having each of its ends connected to a different one of the lifting arm holders 261. However, the use of two hydraulic cylinders provides better control of the movement of the lifting arm assemblies. The hydraulic cylinders 269 and 270 can be connected by unillustrated hydraulic lines to the hydraulic system of the forklift 10 and controlled by hydraulic control valves, such as manually operated valves, mounted on a portion of the forklift 10 where they are easily accessible by the operator of the forklift 10. The hydraulic cylinders 269 and 270 can be controlled so as to move the lifting arm assemblies 260*a* and 260*b* simultaneously with each other or sequentially. Hydraulic circuits for operating hydraulic cylinders so as to grasp a load with a controlled force and release the load are well known, and a conventional circuit of this type can be used in the present invention.

The lifting arms 280 and 290 can be moved close enough to each other in the lengthwise direction of the beam 251 that the opposing surfaces of the lifting arms are pressed against the sides of bucket(s) 40 disposed between the lifting arms with sufficient force for the lifting arms to support the weight of the buckets 40 contacted by the lifting arms and any other buckets stacked atop those buckets when the lifting arms are raised by the forklift 10. In addition, the lifting arms 280 and 290 can be moved far enough from each other in the lengthwise direction of the beam 251 of the arm support assembly 250 such that the lifting arms can be moved in their lengthwise direction along opposite sides of a row of buckets 40 without any portion of the lifting arms 280 and 290 contacting the buckets 40, or such that any contact is sufficiently light that movement of the lifting arms along a row of buckets 40 will not disturb the position of any of the buckets in the row or cause abrasion of the buckets.

In many situations, when the clamping apparatus 200 is grasping a load, the first lifting arm 280 will be disposed between two adjoining rows of buckets 40, i.e., between a row of buckets to be grasped and an adjoining row of buckets. In such situations, the first lifting arm 280 only needs to travel a short distance as it moves into and out of contact with the sides of the buckets 40 to be grasped. In contrast, the second lifting arm 290 will typically be moved by a larger distance as it grasps or separates from a row of buckets. Therefore, the first and second hydraulic cylinders 269 and 270 may be set to have different strokes from each other. For example, in the present embodiment, the first hydraulic cylinder 269 for the first lifting arm 280 has a maximum stroke of around 2 inches, while the second hydraulic cylinder 270 for the second lifting arm 290 has a maximum stroke of around 7 inches.

The maximum force exerted by the lifting arms 280 and 290 against a load can be controlled by a conventional relief valve installed in the hydraulic circuit for the hydraulic cylinders 269 and 270. The maximum force can be set in accordance with the size and the nature of the load to be lifted. The relief valve can be set in advance to a fixed value, or it may be an adjustable relief value which can be adjusted by the operator of the forklift 10 in accordance with the load.

Figure 11:
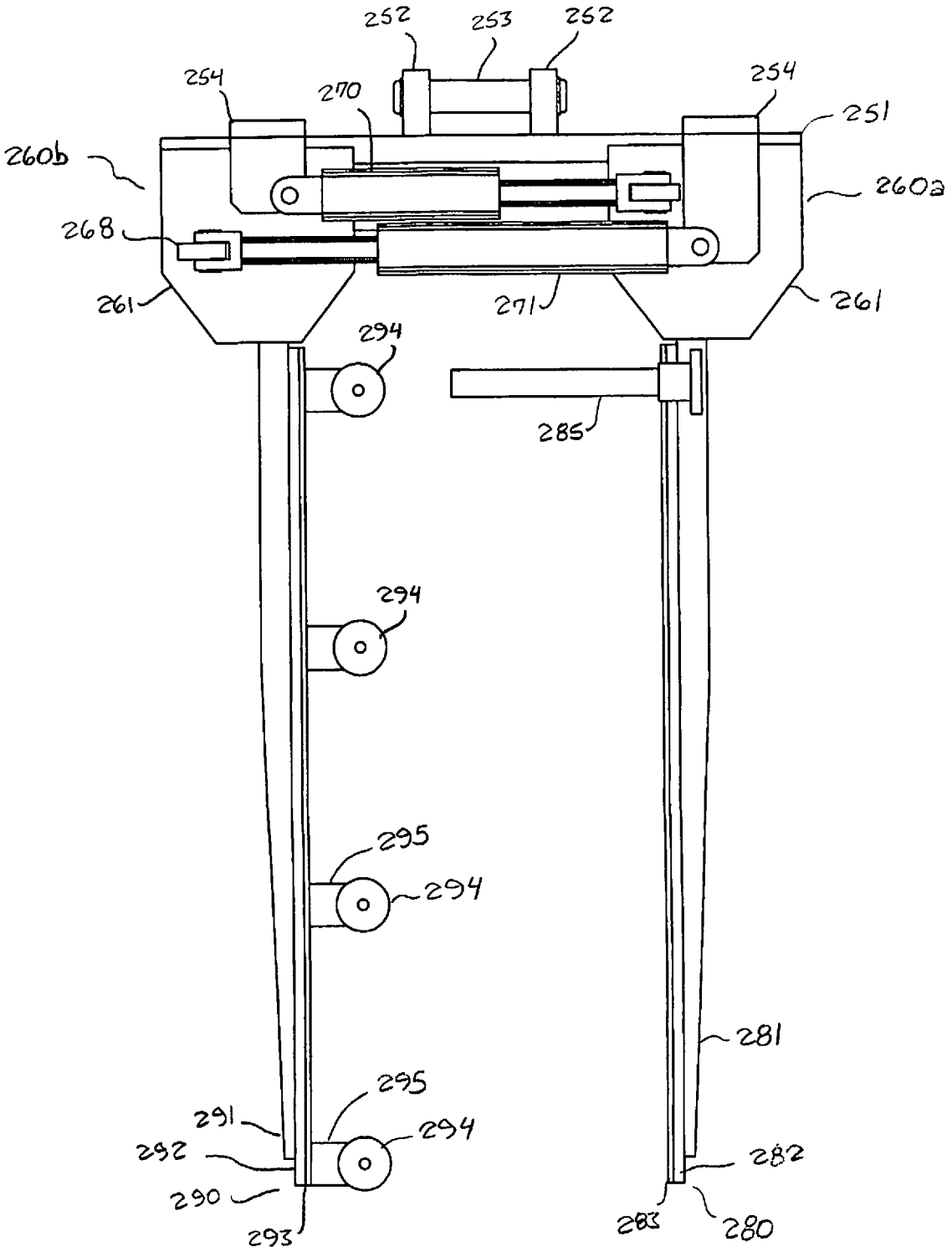
FIG. 11 is a top plan view of the arm support assembly and the lifting arm assemblies of the embodiment of FIG. 6.

As in the previous embodiment, the lifting arms 280 and 290 are not restricted to a particular structure. As best shown in FIG. 11, in the present embodiment, the first lifting arm 280 includes an elongated rigid body 281 which is secured at one end to vertical plate 265 of the lifting arm holder 261 for the first lifting arm 280. The body 281 provides strength to the first lifting arm 280 and is the principal portion of the first lifting arm 280 which bears the weight of the load being grasped by the first lifting arm 280. The illustrated body 281 is formed by cutting off the shank (the vertical portion) of a conventional fork for a forklift and using the blade (the horizontal portion) of the fork as the body 281. Holes are drilled in one end of the body 281, and the body 281 is secured to vertical plate 265 of the lifting arm holder 261 of the first lifting arm assembly 260*a* by bolts passing through the holes in the body 281. A fork for a forklift is usually made of extremely hard steel in which it is difficult to bore threaded holes. Therefore, in order to make it easier to attach items to the body 281, a mounting plate 282 made of a softer material than the body 281 (such as A36 steel) is secured to one surface of the body 281. A nonskid material 283 like that used in the first embodiment is secured to the mounting plate 282. The nonskid material 283 has better gripping properties than the mounting plate 282, and it is also softer than the mounting plate 282, whereby abrasion of a bucket 40 grasped by the first lifting arm 280 can be reduced. The outer surface of the nonskid material 283 (the surface facing away from the mounting plate 282) defines a contact surface of the first lifting arm 280 which is pressed against the side of a bucket when the lifting arms 280 and 290 are grasping a bucket. The overall thickness of the first lifting arm 280 over at least a portion of its length is preferably sufficiently small that the first lifting arm 280 can be inserted into the gap between two adjoining rows of buckets 40 disposed on a pallet 30 by a distance corresponding to the diameters of the number of buckets which are to be grasped without disturbing the spacing between the adjoining rows. For example, the first lifting arm 280 can have a thickness such that it can be inserted into the gap between two adjoining rows of buckets 40 by a distance corresponding to the diameters of three buckets without contacting the sides of the buckets in either row.

Figure 13:
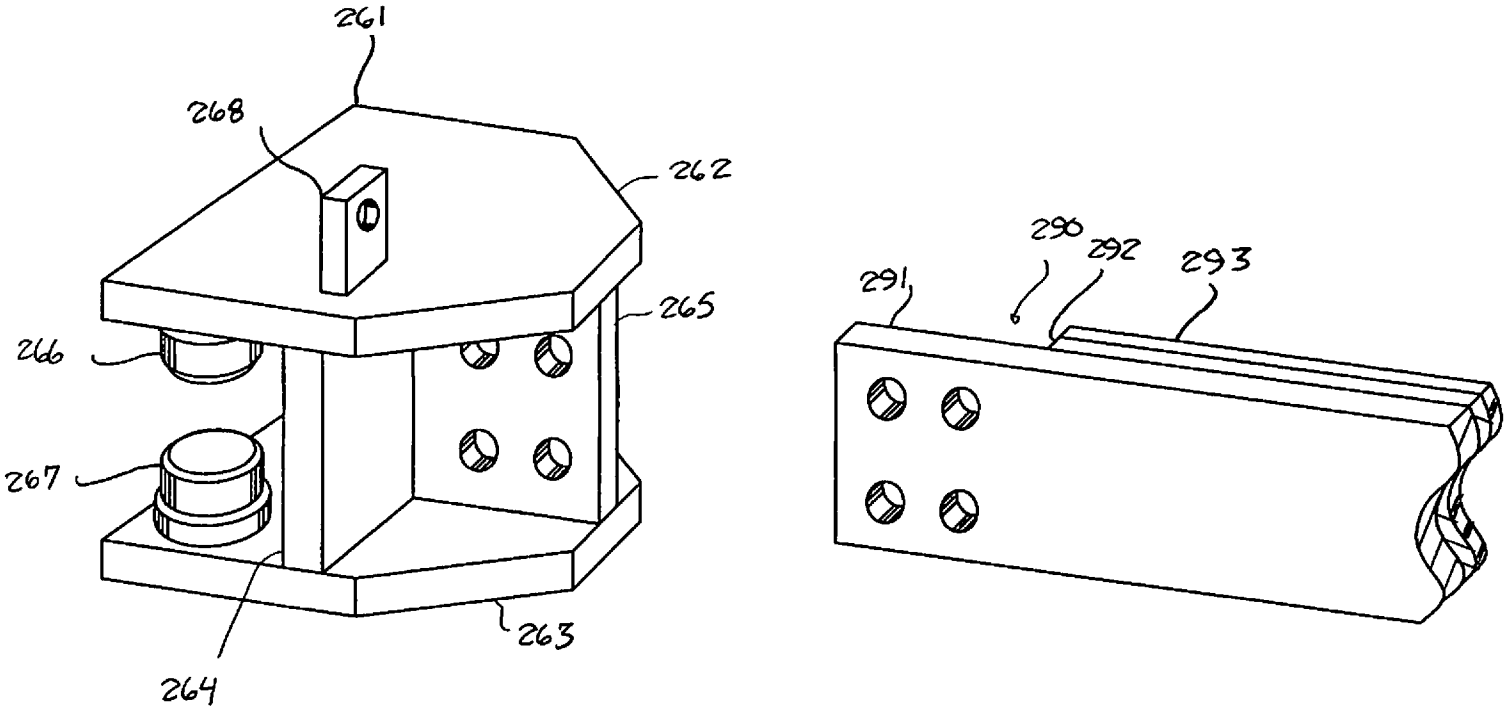
FIG. 13 is an exploded axonometric view of one of the lifting arm assemblies.

The second lifting arm 290 also comprises an elongated rigid body 291, a mounting plate 292, and a nonskid material 293 corresponding to the body 281, the mounting plate 292, and the nonskid material 283 of the first lifting arm 280. The outer surface of the nonskid material 293 (the surface facing away from the mounting plate 292) defines a contact surface of the second lifting arm 290 which is pressed against the side of a bucket when the lifting arms 280 and 290 are grasping a bucket. As shown in FIG. 13, which is an exploded axonometric view of the second lifting arm assembly 260*b*, the body 291 of the second lifting arm 290 is secured to vertical plate 265 of the lifting arm holder 261 of the second lifting arm assembly 260*b* by bolts passing through the holes in the body 291.

The contact surfaces of the lifting arms may be textured to increase the ability of the lifting arms to grip a bucket. For example, the nonskid materials 283 and 293 may have small bumps or ridges formed on their outer surface as is common when the nonskid materials are made of a conveyor belt material. However, the contact surfaces are preferably substantially planar in the sense that it is possible for an imaginary plane to be tangent to each contact surface over substantially the entire length of the corresponding lifting arm.

The second lifting arm 290 is also equipped with a plurality of rollers 294 for controlling the spacing between buckets 40 being grasped by the lifting arms in the lengthwise direction of the lifting arms. Each of the rollers 294 has a generally vertical axis of rotation so as to be able to rotate as the second lifting arm 290 is moved into contact with the sides of buckets 40. The number of rollers 294 is not restricted and depends upon the number of buckets 40 which the lifting arms 290 are designed to be able to grip at one time. Typically the number of locations along the length of the second lifting arm 290 where the rollers 294 are installed will be one greater than the maximum number of buckets 40 which the clamping apparatus 200 is designed to grasp at one time so that each bucket is disposed between two rollers. For example, if the clamping apparatus 200 is designed to grasp up to three buckets 40 at one time, rollers 294 will be installed at four locations along the length of the second lifting arm 290.

Figure 15:
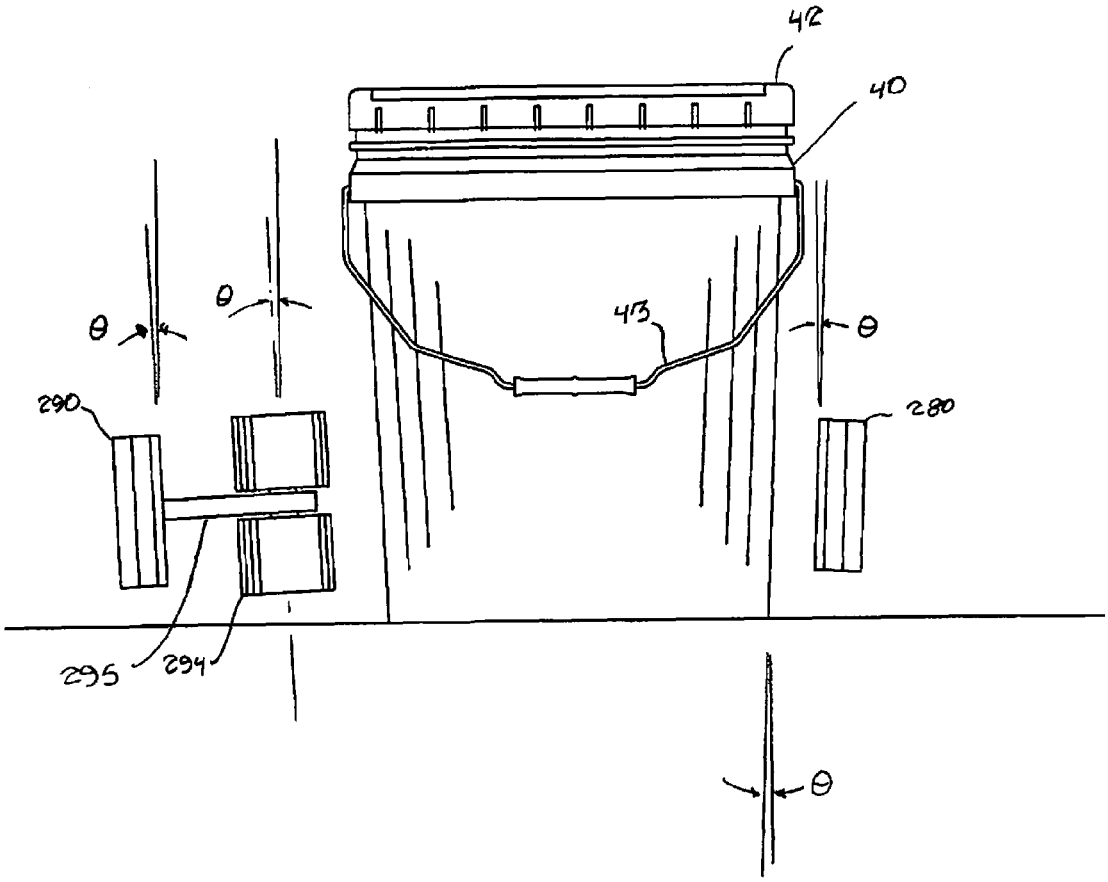
FIG. 15 is a schematic elevation of the lifting arms of the embodiment of FIG. 6 disposed on opposite sides of a bucket, showing the angle of slope of the contact surfaces of the lifting arms with respect to the angle of slope of the sides of the bucket.

FIG. 15 is a schematic elevation of the first and second lifting arms 280 and 290 disposed on opposite sides of a bucket 40 which is to be grasped by the lifting arms as viewed in the lengthwise direction of the lifting arms. As in the first embodiment, the contact surfaces of the lifting arms 280 and 290 are preferably sloped with respect to the vertical by an angle θ which is preferably the same as the angle of slope θ of the sides of the bucket 40 with respect to the vertical, which as stated above is typically on the order of 2-3 degrees. The angle of the axis of the rollers 294 with respect to the vertical is not limited, but typically it will be at most 30 degrees and more frequently at most 10 degrees. When the rollers 294 have a cylindrical outer surface, the rotational axis of the rollers 294 is preferably sloped with respect to the vertical by the angle of slope θ of the sides of the bucket 40. The angle of slope θ of the contact surfaces of the lifting arms 280 and 290 can be set to a desired value by, for example, inserting shims between the body 281 and 291 of each lifting arm 280 and 290 and vertical plate 265 of the corresponding lifting arm holder 261 to which the body 281 or 291 is bolted. When the angle of slope of the rollers 294 is the same as the angle of slope of the contact surfaces of the lifting arms 280 and 290 as shown in FIG. 15, both angles of slope can be set simultaneously.

The rollers 294 can be rotatably supported by the second lifting arm 290 in any desired manner for rotation about a generally vertical axis. In the present embodiment, each roller 294 is rotatably supported on a support plate 295 which is secured to the mounting plate 292 of the second lifting arm 290 by welding, for example, and extends perpendicularly from the support plate 295. An unillustrated shaft extends generally vertically from the support plate 295 in the axial direction of the rollers 294 and rotatably supports the rollers 294. A single roller 294 may be mounted on each support plate 295, but in the present embodiment, two rollers 294 are pivotably supported on the top and bottom sides of each support plate 295. The two rollers 294 on each support plate 295 may be coaxial with each other, but it is also possible for the axes of the rollers 294 on a support plate 295 to be offset with respect to each other.

For ease of manufacture and assembly, all of the rollers 294 in this embodiment have the same diameter as each other, but it is possible for the roller diameter to vary among the rollers 294. In addition, in the present embodiment, the center-to-center spacing between consecutive rollers 294 in the lengthwise direction of the second lifting arm 290 is the same for all the rollers 294, but it is also possible for the spacing to vary.

The spacing between adjoining buckets 40 grasped by the lifting arms 280 and 290 as measured in the lengthwise direction of the lifting arms is determined by the locations of the rotational centers of the rollers 294 and the diameters of the rollers 294. In the present embodiment, the locations of the rotational centers of the rollers 294 and the diameters of the rollers 294 are selected so that when a row of buckets 40 is grasped by the lifting arm 280 and 290, adjoining buckets 40 in the row will touch each other at their upper ends. However, as described below, it is also possible to select the locations and diameters of the rollers 294 so that there is a gap between adjoining buckets 40 at their upper ends.

Figure 10:
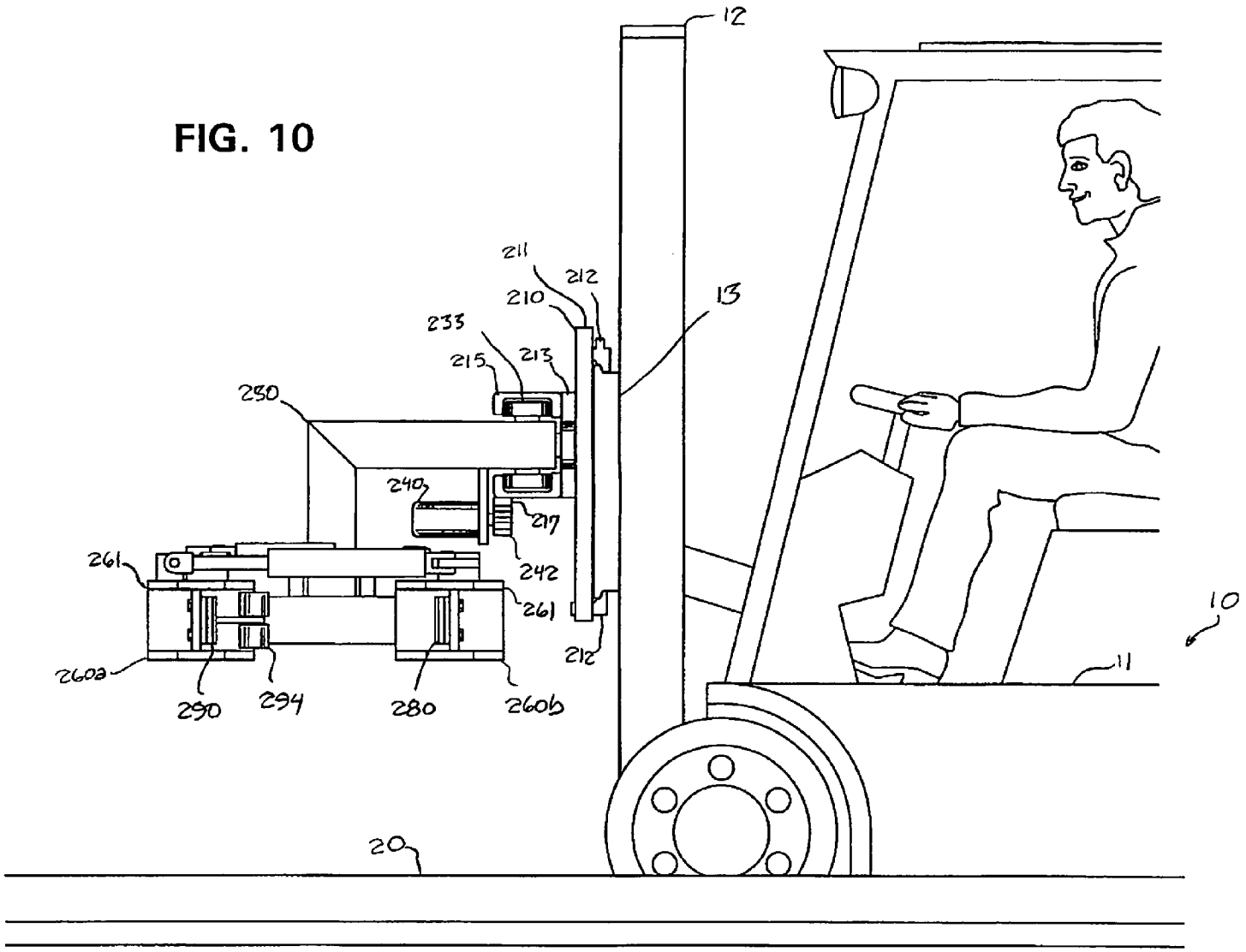
FIG. 10 is a side elevation of the embodiment of FIG. 6 when mounted on the front of a forklift as viewed from the right side in FIG. 6.
Figure 16A:
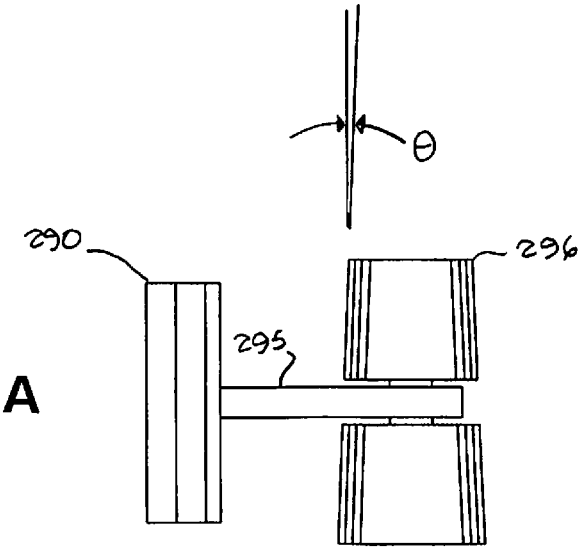
FIGS. 16A-16C are schematic elevations of a lifting arm showing examples of possible shapes of the rollers of the lifting arm.
Figure 16B:
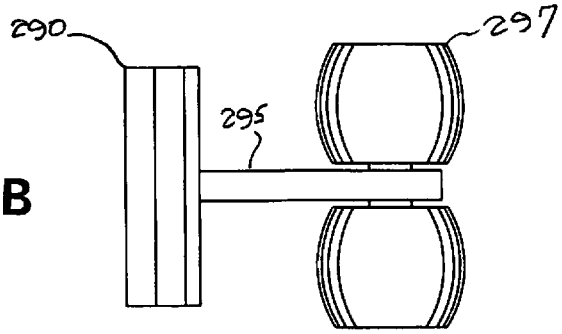
Figure 16C:
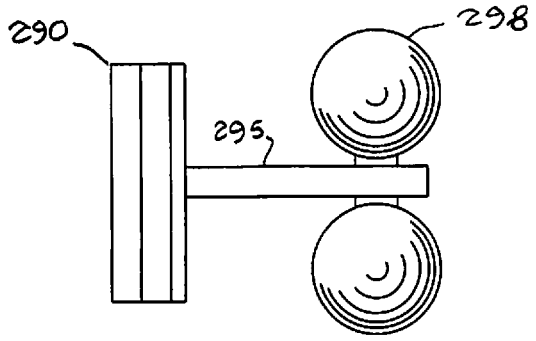

The rollers 294 are not restricted to a particular shape. Typically the outer surface of at least the portion of a roller 294 which contacts a bucket is a surface of revolution. In the present embodiment, each roller has a cylindrical outer periphery with a constant outer diameter over its entire length. FIGS. 16A-16C are schematic elevations of examples of rollers having other possible shapes. FIG. 16A illustrates rollers 296 having a frustoconical shape which tapers from the lower end to the upper end of the rollers 296. The angle of taper θ of the rollers 296 (which matches the angle of slope of the rollers 296 when the rotational axis of the rollers 296 is vertical) is preferably the same as the angle of slope θ of the sides of a bucket 40 (as shown in FIG. 10). FIG. 16B illustrates rollers 297 having a barrel shape. FIG.

16C illustrates rollers 297 having a spherical shape. In each of these examples, the rollers are mounted on a support plate 295 which is secured to the mounting plate 292 of the second lifting arm 290. In the case of the frustoconical rollers 296 of FIG. 16A, if the rotational axis of the rollers 296 is vertical and the angle of slope θ of the surface of the rollers 296 with respect to the vertical is equal to the angle of slope θ of the side of a bucket 40, the rollers 296 can be in line contact with the side of the bucket 40 over the entire height of the rollers 296.

The outer diameter of a roller 294 is preferably selected so that when the contact surfaces of the lifting arms 280 and 290 are pressed against the sides of one or more buckets 40 with sufficient force to be able to lift the buckets 40, each roller 294 contacts the side of at least one bucket 40. The purpose of the rollers 294 is primarily to position the buckets 40 in the lengthwise direction of the lifting arms 280 and 290 rather than to support the weight of the buckets 40, so it is not necessary for the rollers 294 to contact the buckets 40 with any significant force, and it is even possible for a roller 294 to be spaced from the side of a bucket 40 grasped between the lifting arms 280 and 290. However, providing contact between the rollers 294 and the buckets 40 when the buckets are grasped between opposing lifting arms 280 and 290 ensures that the buckets 40 are properly positioned with respect to each other in the lengthwise direction of the lifting arms. Plastic buckets for paint and other liquids are usually capable of being squeezed to a certain extent without damage or permanent indentation of the buckets, so it is permissible for the rollers 294 to be pressed against the buckets held between the lifting arms 280 and 290 with sufficient force to locally indent the buckets 40, with any indentation caused by the rollers 294 being pressed against the buckets 40 disappearing when the rollers 294 are moved away from the sides of the buckets 40.

The height at which the rollers 294 contact the buckets 40 is not restricted, although when the buckets 40 are equipped with handles 43, the height of the upper ends of the rollers 294 is preferably such that the rollers 294 do not contact the handles 43 when the contact surface of the second lifting aim 290 is pressed against the sides of the buckets 40.

The rollers 294 may be made of a variety of materials, including metal, wood, plastic, and hard rubber. Rollers made of soft rubber are also possible, but depending upon the weight of the buckets 40 being grasped by the clamping apparatus 200, soft rubber may deform too readily. In the present embodiment, the rollers 294 are made of a hard MDS (molybdenum disulfide) filled plastic.

The width of each lifting arm 280 and 290 (the distance from its upper to its lower edge) is preferably selected so that each lifting arm can be pressed against the side of a bucket 40 without the lifting arm contacting the handle 43 of the bucket 40 to avoid damage to the handle. In the case of a typical 5-gallon bucket, the lowest point on the handle is generally about 6 inches above the lower end of the bucket. Therefore, giving the lifting arms 280 and 290 a width of less than 6 inches makes it easier for the lifting arms to grasp a bucket without contacting the handle of the bucket. In the present embodiment, the body 281 and 291, the mounting plate 282 and 292, and the nonskid material 283 and 293 of each lifting arm 280 and 290 have a width of approximately 4 inches. In addition, the total of the thickness of each support plate 295 and the length of the two rollers 294 rotatably mounted on the support plate 295 is under 6 inches. Therefore, the first and second lifting arms 280 and 290 can easily be contacted with the sides of a bucket 40 without contacting the handle 43 of the bucket 40.

As mentioned above, a typical 5-gallon bucket has an outer diameter at its lower end of approximately 10 inches and an outer diameter at its upper end of approximately 12 inches. At a height of 6 inches above the bottom of the bucket, which corresponds to the approximate height of the lowest portion of the handle 43 of a typical 5-gallon bucket, the outer diameter of the bucket is frequently around 10.7 inches. If two 5-gallon buckets are placed next to each other so as to contact each other at their upper ends, the center-to-center spacing of the two buckets is approximately 12 inches, and the spacing between the two buckets at a height of 6 inches above the bottom of the buckets is around 1.3 inches. If the thickness of the upper end of the first lifting arm 280 is less than 1.3 inches over a region of the first lifting arm 280 which is inserted between two rows of buckets, this region of the first lifting arm 280 can be inserted between the two rows of 5-gallon buckets at a height of at most 6 inches above the bottom of the buckets without contacting the buckets on either side of the first lifting arm 280.

One or both of the lifting arm assemblies 260*a* and 260*b* may be equipped with a positioning member for indicating to the operator of the clamping apparatus 200 how far to extend the lifting arms 280 and 290 with respect to a row of buckets in the lengthwise direction of the lifting arms before bringing the contact surfaces of the lifting arms into contact with the buckets. In the present embodiment, a positioning member comprises a positioning rod 285 which, as shown in FIG. 11, is secured to the first lifting arm 280 in the vicinity of the lifting arm holder 261 and which extends transversely with respect to the first lifting arm 280, such as perpendicular to the lengthwise direction of the first lifting arm 280 towards the second lifting arm 290. In order to simplify the drawings, the positioning rod 285 has been omitted from a number of the figures, such as FIGS. 6, 7, 8, and 10. The height of the positioning rod 285 with respect to the second lifting arm 290 and the length of the positioning rod 285 are selected so that the positioning rod 285 will not strike the second lifting arm 290 when the two lifting arms 280 and 290 are at their closest spacing from each other. The length of the positioning rod 285 is typically at least ½ the diameter of the buckets 40 which are to be grasped by the lifting arms 280 and 290. The positioning rod 285 preferably has a smooth surface so that it can slide along the surface of a bucket 40 as the first lifting arm 280 is moved towards and away from the second lifting arm 290. When the operator of the clamping apparatus 200 wishes to position the lifting arms 280 and 290 with respect to a row of buckets, he advances the lifting arms in their lengthwise direction by moving the carriage 230 of the clamping apparatus 200 in the widthwise direction of the forklift 10 until the positioning rod 285 contacts the first bucket 40 in the row. The locations of the rollers 294 on the second lifting arm 290 in the lengthwise direction of the second lifting arm 290 is preferably selected such that when the positioning rod 285 contacts the first bucket 40 in the row, the first bucket 40 will be centered between the first two sets of rollers 294 in the lengthwise direction of second lifting arm 290.

A positioning member is not limited to a rod, and any member which is capable of abutting against the side of a bucket and sliding with respect to the surface of the bucket as the first and second lifting arms 280 and 290 are moved towards and away from each other can be used as a positioning member.

Figure 17A:
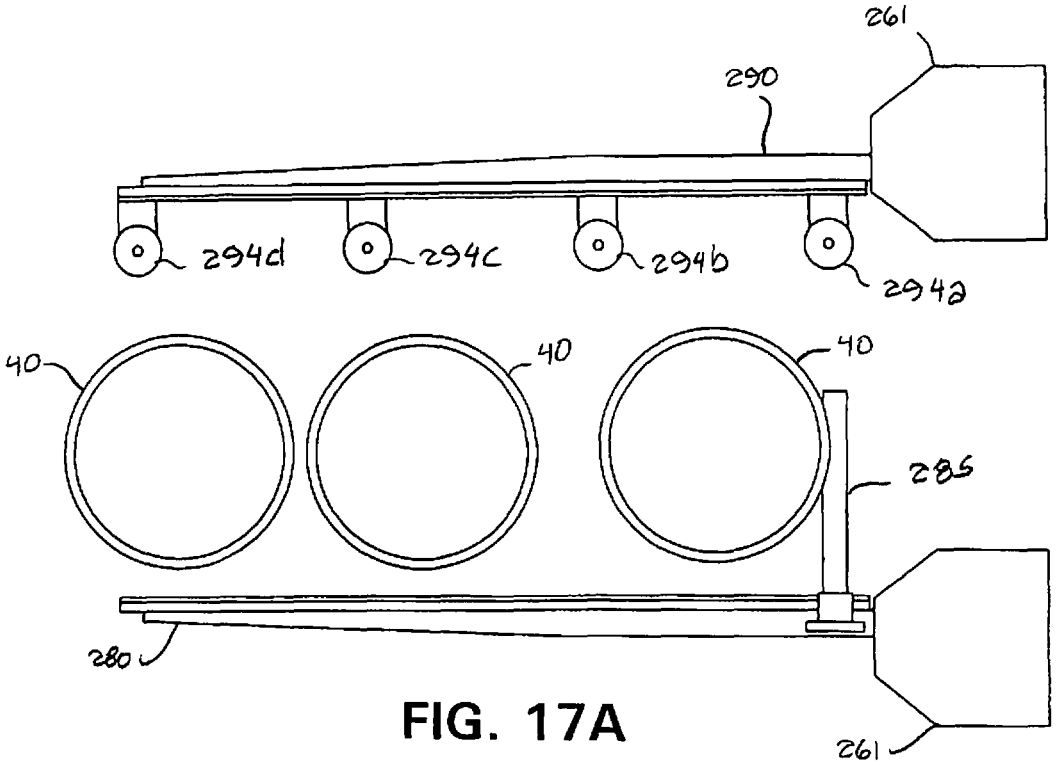
FIGS. 17A and 17B are schematic plan views of the lifting arms of the embodiment of FIG. 6 showing how the clamping apparatus can reduce the spacing between adjoining buckets.
Figure 17B:
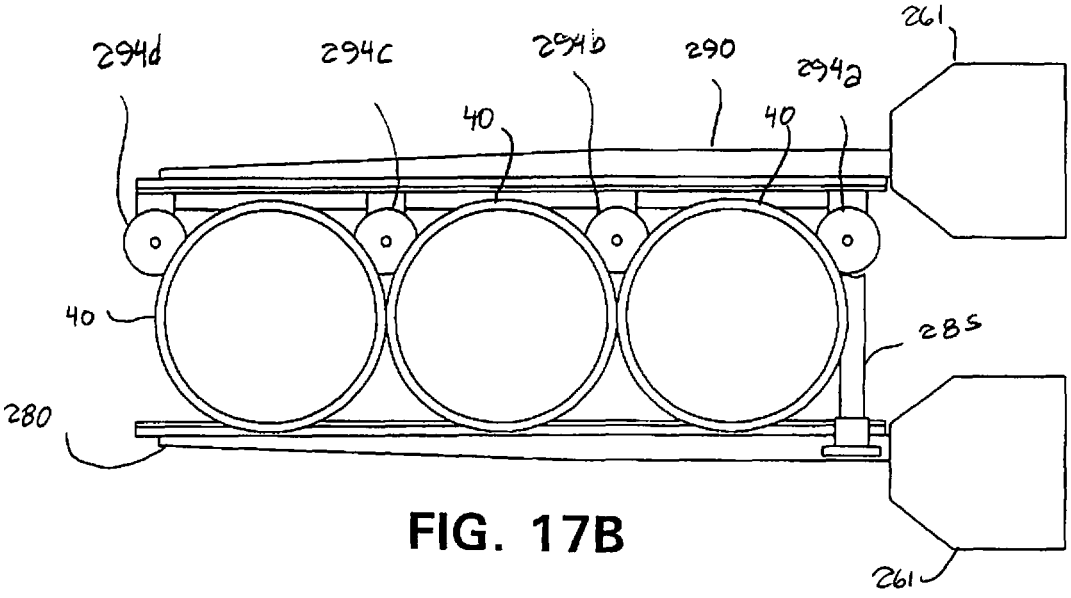

FIGS. 17A and 17B are schematic top plan views of a row of three buckets 40 before and after the buckets 40 have been grasped by the lifting arms 280 and 290 of the present embodiment. The buckets 40 are disposed on a support surface such as an unillustrated pallet. For simplicity, various structural features of the lifting arm assemblies 260*a* and 260*b* (such as the hydraulic cylinders 269 and 270) as well as other portions of the clamping apparatus 200 have been omitted. Before being grasped by the clamping apparatus 200, the spacing between adjoining buckets 40 may be irregular, i.e., it may vary randomly from one bucket to another. An irregular spacing can result when buckets are placed on a pallet by hand or when the positions of buckets on a pallet change during shipment of the pallet. In the state shown in FIG. 17A, the three buckets 40 are not contacting each other, and the spacing between adjoining buckets varies. Specifically, by way of example, the middle bucket 40 in the row is closer to the lefthand bucket than to the righthand bucket. An irregular spacing between buckets 40 makes it difficult to stack one row of buckets atop another row of buckets having a different spacing with each bucket in the one row resting on and nested in the lid of a bucket in the row beneath it. The second lifting arm 290 is equipped with four sets of rollers, with each set including two rollers 294 in the manner shown in FIG. 15. For ease of reference, the four sets of rollers of the second lifting arm 290 will be referred to, from right to left, as first through fourth sets of rollers 294*a*-294*d*.

In the state shown in FIG. 17A, the lifting arms 280 and 290 have been positioned with the positioning rod 285 of the first lifting arm 280 contacting the righthand bucket 40 in the row and with the contact surfaces of the lifting arms 280 and 290 spaced from the sides of all the buckets 40. In this state, due to the contact between the positioning rod 285 and the righthand bucket 40, the righthand bucket is centered with respect to the first set of rollers 294*a* and the second set of rollers 294*b* in the lengthwise direction of the second lifting arm 290. However, the middle bucket 40 is off-center with respect to the second and third sets of rollers 294*b* and 294*c* in the lengthwise direction of the second lifting arm 290, and the lefthand bucket is off-center with respect to the third and fourth sets of rollers 294*c* and 294*d* in the lengthwise direction of the second lifting arm 290.

When the lifting arms 280 and 290 are moved towards each other from the state shown in FIG. 17A, before the contact surfaces of the lifting arms contact the sides of the buckets 40, the sets of rollers 294*a*-294*d* come into contact with the sides of the buckets 40. Since the righthand bucket 40 is already centered between the first and second sets of rollers 294*a* and 294*b* in the lengthwise direction of the second lifting arm 290, it is not moved to the left or right in the figure as the rollers 294 come into contact with it. Since the middle bucket 40 is initially off-center with respect to the second and third sets of rollers 294*b* and 294*c* in the lengthwise direction of the second lifting arm 290, the contact between the middle bucket 40 and the second and third sets of rollers 294*b* and 294*c* will cause the middle bucket to shift to the right in the figures until it is centered with respect to the second and third sets of rollers 294*b* and 294*c* in the lengthwise direction of the second lifting arm 290 as shown in FIG. 17B. Similarly, the lefthand bucket 40 is initially off-center with respect to the third and fourth sets of rollers 294*c* and 294*d* in the lengthwise direction of the second lifting arm 290, so the contact between the lefthand bucket 40 and the third and fourth sets of rollers 294*c* and 294*d* will cause the lefthand bucket 40 to shift to the right in the figures until it is centered with respect to the third and fourth sets of rollers 294*c* and 294*d* in the lengthwise direction of the second lifting arm 290 as shown in FIG. 17B. In the state shown in FIG. 17B, the center-to-center spacing between adjoining buckets 40 is now uniform, and the upper end of each bucket 40 is contacting the upper end of the adjoining bucket 40.

The type of motion which a bucket 40 undergoes when it contacts the rollers 294 as the lifting arms 280 and 290 are moved towards each other depends upon factors such as the smoothness of the support surface on which the buckets 40 are disposed, the weight of the buckets 40, and the coefficients of friction of the rollers 294 and the buckets 40. In some cases, a bucket 40 simply translates laterally without any change in its orientation. In other cases, a bucket rotates about a vertical axis while translating to the left or right, i.e., it rolls as it translates. For example, the middle and lefthand buckets 40 in FIGS. 17A and 17B may rotate about their centers as they are moved from the positions shown in FIG. 17A to the positions shown in FIG. 17B.

Figure 18A:
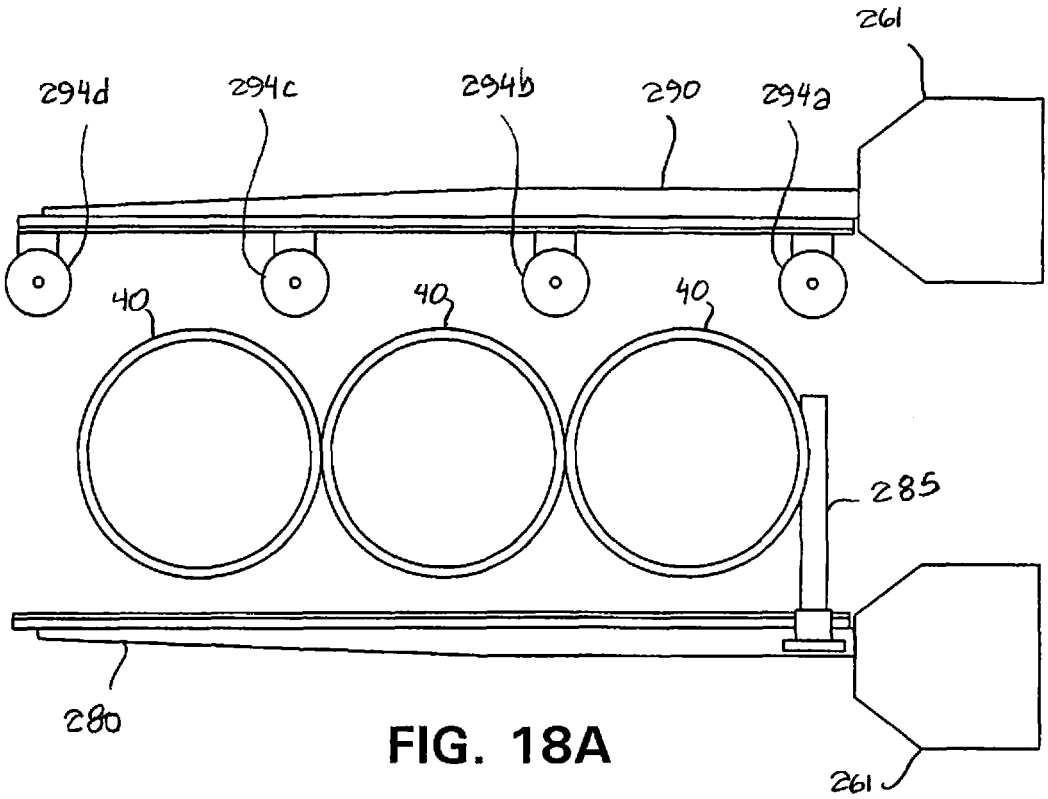
FIGS. 18A and 18B are schematic plan views of the lifting arms of the embodiment of FIG. 6 showing how the clamping apparatus can increase the spacing between adjoining buckets.
Figure 18B:
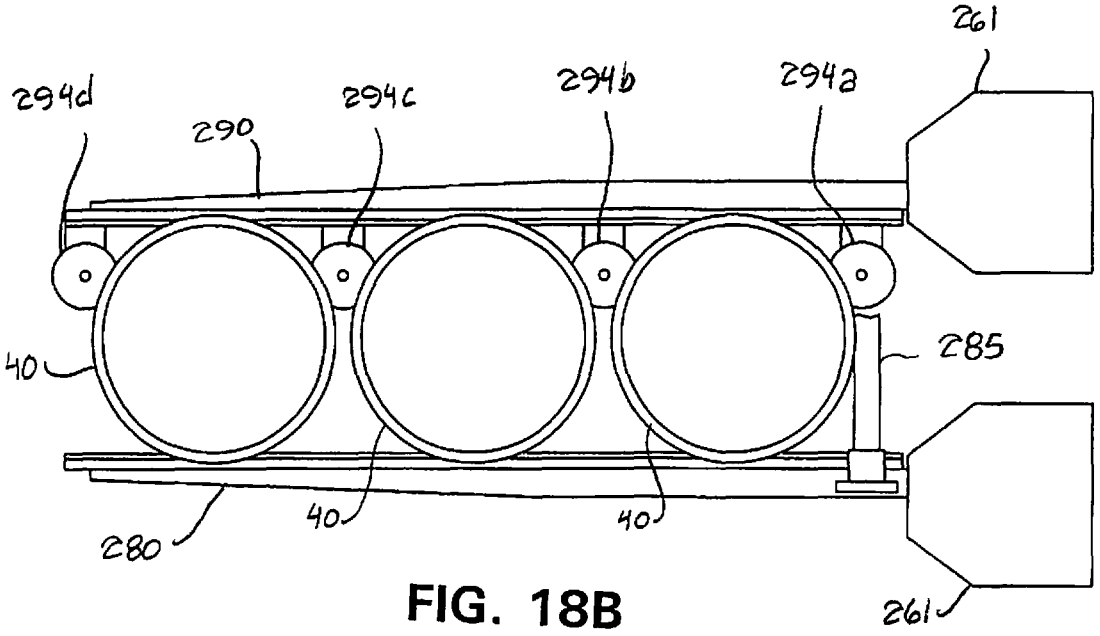

In FIGS. 17A and 17B, a clamping apparatus 200 according to the present invention is used to decrease the spacing between adjoining buckets 40 in a row. The clamping apparatus 200 can also be employed to increase the spacing between adjoining buckets 40. A user might wish to increase the spacing between adjoining buckets 40 when he wishes to transfer a row of buckets which contact each other at their upper ends to atop another row of buckets having a prescribed nonzero spacing between the upper ends of adjoining buckets so that each of the buckets 40 in the row being transferred will nest inside the lid of one of the buckets in the row atop which the row being transferred is to be placed. In this case, the spacing between adjoining sets of rollers in the lengthwise direction of the second lifting arm 290 is increased compared to the spacing in FIGS. 17A and 17B. At the same time that the spacing between adjoining sets of rollers is increased, the diameter of the rollers 294 and/or the distance of the center of each roller 294 from the contact surface of the second lifting arm 290 is also increased so as to produce a desired contact pressure between the rollers 294 and the buckets 40. FIGS. 18A and 18B are schematic plan views of a clamping apparatus 200 according to the present invention being used to increase the spacing between adjoining buckets in a row of three buckets 40. FIG. 18A shows the state before the lifting arms 280 and 290 have contacted the buckets 40, and FIG. 18B shows the state after the contact surfaces of the lifting arms 280 and 290 have grasped the buckets 40. As is the case with respect to FIGS. 17A and 17B, the sets of rollers of the second lifting arm 290 will be referred to, from right to left, as first through fourth sets of rollers 294*a*-294*d*.

As shown in FIG. 18A, prior to being contacted by the lifting arms 280 and 290, all three buckets 40 in the row are contacting each adjoining bucket 40 at its upper end. The lifting arms 280 and 290 are positioned in their lengthwise direction so that the positioning rod 285 is contacting the righthand bucket 40 in the row. Due to this contact, the righthand bucket 40 is centered with respect to the first and second sets of rollers 294*a* and 294*b* in the lengthwise direction of the second lifting arm 290. However, the middle bucket and the lefthand bucket are off-center with respect to the remaining sets of rollers 294*b*-294*d* in the lengthwise direction of the second lifting arm 290. When the lifting arms 280 and 290 are moved towards each other and the rollers 294 come into contact with the sides of the buckets 40, the position of the righthand bucket 40 in the lengthwise direction of the second lifting arm 290 does not change. However, the middle bucket 40 and the lefthand bucket 40 are shifted to the left in the figures until the middle bucket 40 is centered with respect to the second and third sets of rollers 294*b* and 294*c* in the lengthwise direction of the second lifting arm 290, and the lefthand bucket 40 is centered with respect to the third and fourth sets of rollers 294*c* and 294*d* in the lengthwise direction of the second lifting arm 290. In this state, each bucket 40 is spaced from the adjoining bucket at its upper end by a prescribed amount determined by the spacing between adjoining sets of rollers 294*a*-294*d*. Although it is usually desirable for the spacing between adjoining buckets to be uniform among the buckets 40, depending upon the needs of the user of the clamping apparatus 200, it is possible to select the spacing between the adjoining sets of rollers 294*a*-294*d* so that the spacing between adjoining buckets 40 varies among the buckets. For example, the spacing between adjoining sets of rollers could be set such that when the lifting arms 280 and 290 have been pressed against a row of buckets, two of the buckets 40 in the row contact each other at their upper ends while the third bucket in the row is spaced from the adjoining bucket at its upper end.

As is the case with respect to FIGS. 17A and 17B, the middle and lefthand buckets 40 may rotate about their centers as they are moved from the positions shown in FIG. 18A to the positions shown in FIG. 18B.

The procedure for using the clamping apparatus 200 to decrease the spacing between adjoining buckets 40 in a row illustrated in FIGS. 17A and 17B and the procedure for using the clamping apparatus 200 to increase the spacing between adjoining buckets 40 in a row can be performed regardless of whether the row of buckets 40 comprises a single layer of buckets or multiple layers in a nested or non-nested relationship.

For the same reasons that the spacing between adjoining buckets 40 on a pallet may be irregular, the buckets 40 in a row on a pallet might not be exactly aligned with each other. However, as shown in FIGS. 17B and 18B, when the contact surfaces of the lifting arms 280 and 290 of the clamping apparatus 200 are pressed against the sides of the buckets 40 in a row, all of the buckets 40 in the row can be precisely aligned with each other so that a straight line can be passed through the centers of the buckets 40. The ability of the clamping apparatus 200 to align the buckets 40 in a row makes it easier to stack the row atop another row of buckets in a nested relationship or to place the row of buckets grasped by the clamping apparatus 200 in close proximity to (such as contacting) another row of buckets.

FIGS. 19A-19D are schematic plan views of the lifting arms 280 and 290 of the clamping apparatus 200 in the process of lifting a row of buckets 40 from a support surface such as an unillustrated pallet, and FIGS. 20A-20C are schematic elevations of the lifting arms 280 and 290 and the buckets 40 in states corresponding to those shown in FIG. 19B-19D, respectively. For simplicity, only the lifting arms 280 and 290 and the lifting arm holders 261 of the clamping apparatus 200 are shown in these figures, and the forklift 10, the guide rail 20, and other portions of the clamping apparatus 200 have been omitted. For simplicity, FIGS. 19A-19D show only two rows of buckets 40, but the number of rows does not affect the operation of the clamping apparatus 200.

In order to grasp a row of buckets 40 with the clamping apparatus 200, the operator of the forklift 10 drives the forklift 10 along the guide rail 20 until the first lifting arm 280 is aligned with the gap between the adjoining rows of buckets 40 as shown in FIG. 19A. In this state, the lifting arms 280 and 290 are in their retracted position illustrated in FIG. 6 in which the forklift 10 can travel along the guide rail 20 without the lifting arms 280 and 290 contacting objects placed on pallets adjoining the guide rail 20.

From the state shown in FIG. 19A, the operator advances the lifting arms 280 and 290 in their lengthwise direction (towards the lower end of FIG. 19A) by operating the hydraulic motor 240 to move the carriage 230 along the support frame 210 to insert the first lifting arm 280 into the space between the two rows of buckets 40 until the positioning rod 285 contacts the end bucket in the row, as shown in FIG. 19B. In this state, the lifting arms 280 and 290 are in their extended position illustrated in FIG. 7. When the lifting arms 280 and 290 are being extended, they are preferably spread apart from each other by a sufficient distance that neither the contact surface of the first lifting arm 280 nor the rollers 294 of the second lifting arm 290 contact the sides of the buckets 40 in either row or so that the first lifting arm 280 at most lightly contacts the buckets 40 on either side of it. FIG. 20A is an elevation of the lifting arms and the two rows of buckets 40 in the state shown in FIG. 19B.

As shown in FIG. 19C and FIG. 20B, the operator of the forklift 10 then operates the hydraulic cylinders 269 and 270 of the lifting arm assemblies 260*a* and 260*b* to bring the contact surfaces of both lifting arms 280 and 290 into contact with the sides of the buckets 40 in the lefthand row of buckets 40 with a predetermined pressure sufficient for the lifting arms 280 and 290 to support the weight of the buckets when the lifting arms are raised. At the same time, the rollers 294 on the second lifting arm 290 are brought into contact with the buckets 40 in the lefthand row to assure a desired spacing between adjoining buckets 40 in the row. If the spacing between adjoining buckets 40 is already the desired spacing determined by the spacing between adjacent rollers 294 of the second lifting arm 290, contact between the rollers 294 and the buckets 40 will not modify the spacing between the buckets 40.

The operator of the forklift 10 is now ready to remove the lefthand row of buckets 40 from the support surface on which the buckets 40 are sitting. When two adjoining rows of buckets 40 are contacting each other as shown in FIG. 20B, if the operator lifts the lefthand row of buckets 40 straight up to above the righthand row, the first lifting arm 280 might strike against some portion of the righthand row of buckets 40 as the first lifting arm 280 is raised and upset the positions of the buckets 40 or even damage the buckets 40 in the righthand row. Therefore, instead of raising the lefthand row of buckets 40 straight up in a single movement, the operator can control the forklift 10 so as to both raise the lefthand row of buckets 40 above the support surface and to translate the lefthand row to the left away from the righthand row of buckets 40 so that the first lifting arm 280 will not strike the righthand row of buckets 40. For example, the operator can first raise the lefthand row of buckets 40 slightly off the support surface, such as by one inch, by raising the lifting arms 280 and 290, and then move the lefthand row of buckets 40 to the left in the figures until the first lifting arm 280 is sufficiently spaced from the righthand row of buckets 40 as shown in FIGS. 19D and 20C such that no portion of the buckets 40 in the righthand row lies directly above the first lifting arm 280. The operator can then lift the lefthand row of buckets 40 to a desired height without any danger of the first lifting arm 280 striking the righthand row of buckets 40. The operator of the forklift 10 can raise and lower the buckets 40 by raising and lowering the entire clamping apparatus 200 along the mast 12 of the forklift 10, while the operator can translate the buckets 40 horizontally to the left or right in FIGS. 19D and 20C by driving the forklift 10 forwards or backwards along the guide rail 20.

When the lefthand row of buckets 40 has been raised to a suitable height, the operator of the forklift 10 can then drive the forklift 10 along the guide rail 20 and deposit the buckets 40 in a new location. When the forklift 10 is traveling along the guide rail 20 to transport the buckets 40 to another location, the lifting arms 280 and 290 may be maintained in their extended position shown in FIG. 7, or they may be moved to their retracted position shown in FIG. 6 so as to avoid striking the buckets 40 against objects disposed along the guide rail 20. For example, if the forklift 10 is moving along a path between two rows of shelves, the lifting arms 280 and 290 can be retracted to a position in front of the forklift 10 in which the lifting arms and the buckets 40 held thereby will not strike the shelves. The row of buckets 40 grasped by the lifting arms 280 and 290 can be placed next to (such as in contact with) another row of buckets 40 by performing the steps shown in FIGS. 19A-19D in the reverse order.

Substantially the same procedure as shown in FIGS. 19A-19D and 20A-20C can be used to pick up a portion of the buckets in a row. For example, the lifting arms 280 and 290 can be used to pick up one or two buckets in the lefthand row instead of all three buckets 40 in the row.

In the example described with respect to FIGS. 19A-19D and FIGS. 20A-20C, the row of buckets 40 being grasped by the lifting arms 280 and 290 is one layer high. However, a row of buckets 40 grasped by the lifting arms may have multiple layers of buckets, such as two layers or three layers, with each bucket in an upper layer (any layer above the layer grasped by the lifting arms) nested in the lid of a bucket in the layer below it. In addition, while FIGS. 19A-19D and FIGS. 20A-20C show a row of buckets being removed from atop a support surface such as a pallet, a row of buckets which is picked up by the lifting arms could be stacked atop another row of buckets instead of directly on a pallet with each bucket resting on the lid of a bucket disposed beneath it in a nested or non-nested relationship.

Figure 21:
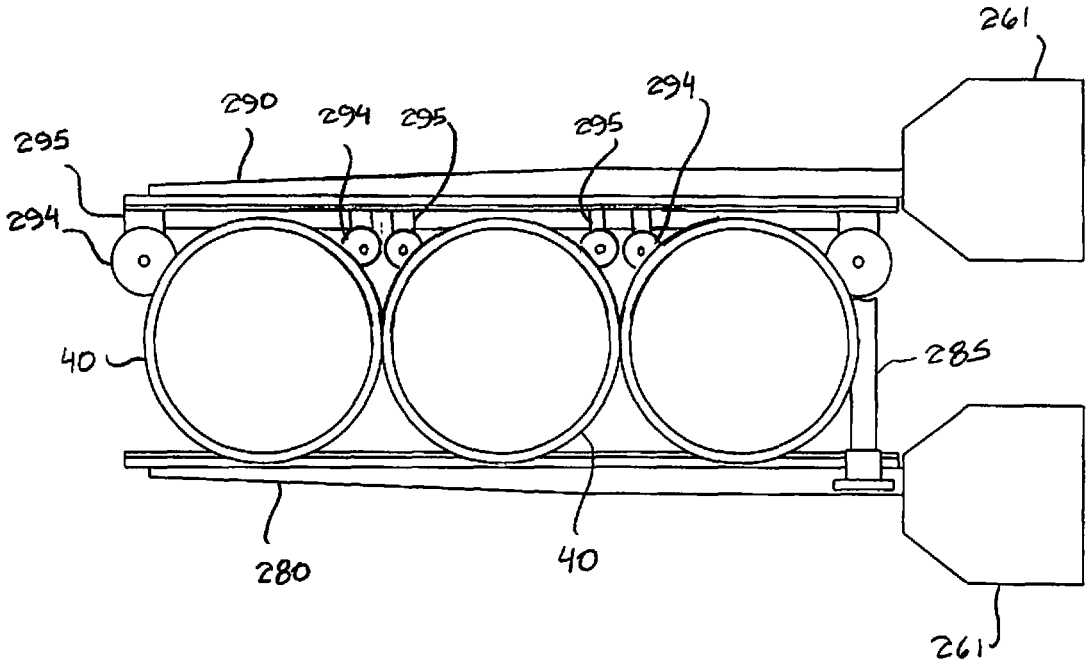
FIG. 21 is a plan view of the lifting arms of a modification of the lifting arm assemblies shown in FIG. 11.

In the example of the lifting arm assemblies 260*a* and 260*b* shown in FIGS. 11-20, all of the rollers 294 have the same diameter as each other. In addition, as shown in FIGS. 17B and 18B, for example, when a roller 294 is disposed between two adjoining buckets 40, each roller 294 contacts both of the adjoining buckets 40. However, as schematically illustrated in FIG. 21, it is possible for the diameter of the rollers 294 to vary among the rollers and for a roller 294 to contact a single one of two adjoining buckets 40. In FIG. 21, the rollers 294 disposed at the ends of a row of buckets 40 have a larger diameter than the rollers 294 disposed between the ends of the row. In addition, the smaller-diameter rollers 294 are positioned such that each roller 294 contacts a single one of two adjoining buckets 40. The rollers 294 installed between adjoining buckets 40 are shown as being mounted on individual support plates 295, but two adjoining rollers 294 can be mounted on a single support plate 295. The example shown in FIG. 21 can be used in the same manner as the examples shown in FIGS. 17A and 18A. Many other variations in the diameter and number of rollers 294 are possible.

What is claimed is:

1. A clamping apparatus comprising:

a frame adapted for mounting on a forklift having a mast so as to be raised and lowered along the mast, the frame having a widthwise direction which is parallel to a widthwise direction of the forklift and a fore-and-aft direction which is parallel to a fore-and-aft direction of the forklift when the frame is mounted on the forklift;

a carriage supported by the frame for movement with respect to the frame in the widthwise direction of the frame;

first and second lifting arms supported by the carriage and extending in the widthwise direction of the frame, each of the lifting arms having a substantially flat contact surface opposing the contact surface of the other lifting arm for contacting a load between upper and lower ends of the load, the second lifting arm including a plurality of rollers rotatable about a generally vertical axis and positioned on the second lifting arm so as to contact the load between the upper and lower ends of the load and between the contact surfaces of the first and second lifting arms as viewed from above; and a drive mechanism operatively connected to one of the lifting arms for moving the one of the lifting arms in the fore-and-aft direction of the frame to enable the lifting arms to grasp and release the load.

2. A clamping apparatus as claimed in claim 1, wherein the lifting arms are pivotably supported by the carriage for pivoting about a horizontal axis extending in the fore-and-aft direction of the frame, and the angle of the lifting arms with respect to the carriage about the horizontal axis is adjustable.

3. A clamping apparatus as claimed in claim 1 including a positioning member which is mounted on one of the lifting arms and extends transversely with respect to the lengthwise direction of the one of the lifting arms towards the other lifting arm for contacting the load between the upper and lower ends of the load when two adjacent rollers of the plurality of rollers are positioned on opposite sides of a center of the load in the fore-and-aft direction of the frame.

4. A clamping apparatus as claimed in claim 1, wherein the contact surfaces of the lifting arms are sloped with respect to the vertical such that upper ends of the opposing contact surfaces are farther from each other than lower ends of the opposing contact surfaces.

5. A clamping apparatus as claimed in claim 4, wherein each contact surface is sloped by 2-3 degrees with respect to the vertical.

6. A clamping apparatus as claimed in claim 1 wherein the rollers are disposed entirely between the contact surfaces of the first and second lifting arms as viewed from above.

7. A clamping apparatus as claimed in claim 1 wherein each roller has a lower end disposed lower than an upper end of the contact surface of the second lifting arm.

8. A forklift arrangement comprising:

a guide rail disposed on a floor;

a pallet disposed along the guide rail and supporting a layer of closely-spaced objects arranged in rows extending perpendicular to the guide rail with a minimum separation of at most 6 inches between adjoining objects in the layer;

a fork lift which can travel on the floor in a lengthwise direction of the guide rail while engaged with the guide rail; and a clamping apparatus as claimed in claim 1 supported by the fork lift with the lifting arms extending in a widthwise direction of the fork lift.

9. A clamping apparatus arrangement comprising:

a clamping apparatus as claimed in claim 1; and a support apparatus on which the clamping apparatus is mounted and which can raise and lower the clamping apparatus.

10. A method of lifting a plurality of buckets using the clamping apparatus of claim 1 comprising:

moving the carriage along the frame in the widthwise direction of the frame to move the first lifting arm and the second lifting arm in the widthwise direction of the frame along opposite sides of a plurality of buckets disposed in a first row of buckets;

moving the first and second lifting arms towards each other to contact the rollers of the second lifting arm with the plurality of buckets in the first row without the rollers contacting upper ends of the plurality of buckets and to then bring the contact surfaces of the lifting arms into contact with opposite sides of the plurality of buckets to grasp the plurality of buckets with no portion of the plurality of buckets resting on an upper surface of the lifting arms; and raising the clamping apparatus to lift the plurality of buckets.

11. A method as claimed in claim 10 wherein the first row of buckets is disposed next to a second row of buckets having a minimum separation from the first row of at most 6 inches, and moving the first and second lifting arms in the widthwise direction of the frame comprises inserting the first lifting arm between the first and second rows of buckets.

12. A method as claimed in claim 10 including contacting each of the plurality of buckets in the first row with two of the rollers when lifting the plurality of buckets.

13. A method of lifting buckets disposed on a surface using a clamping apparatus which includes a frame adapted for mounting on a forklift having a mast so as to be raised and lowered along the mast, the frame having a widthwise direction which is parallel to a widthwise direction of the forklift and a fore-and-aft direction which is parallel to a fore-and-aft direction of the forklift when the frame is mounted on the forklift, a carriage supported by the frame for movement with respect to the frame in the widthwise direction of the frame, first and second lifting arms supported by the carriage and extending in the widthwise direction of the frame, and a drive mechanism operatively connected to one of the lifting arms for moving the one of the lifting arms in the fore-and-aft direction of the frame to enable the lifting arms to grasp and release a load, the method comprising:

positioning the clamping apparatus with respect to a layer of closely-spaced buckets arranged in a plurality of rows with a minimum separation of at most 6 inches between two adjoining rows such that one of the lifting arms is aligned with a space between a first row of the layer and an adjoining second row of the layer;

moving the carriage along the frame in the widthwise direction of the frame to insert the first lifting arm into the space while moving the other lifting arm on the exterior of the layer until a plurality of the buckets in the first row are disposed between the first and second lifting arms;

contacting the plurality of buckets in the first row with the first and second lifting arms to grasp the plurality of buckets in the first row; and raising the clamping apparatus to lift the plurality of buckets contacted by the lifting arms.

14. A method as claimed in claim 13, wherein the minimum separation between the first row and the second row is at most 1 inch.

15. A method as claimed in claim 13, wherein the buckets in the first row contact the buckets in the second row.

16. A method as claimed in claim 13, wherein no portion of the buckets contacted by the lifting arms rests on an upper surface of the lifting arms.

17. A method as claimed in claim 13, wherein the buckets in the layer of buckets have a nominal size of 5 gallons.

18. A method as claimed in claim 13, wherein the clamping apparatus includes a positioning member which is mounted on one of the lifting arms and extends from the one lifting arm towards the other lifting arm, and the first lifting arm is inserted into the space between the first and second rows until a plurality of the buckets in the first row are disposed between the first and second lifting arms and the positioning member contacts a bucket at a lengthwise end of the first row of buckets.

* * * * *